US007547214B2

(12) United States Patent
Duesterhoeft et al.

(10) Patent No.: US 7,547,214 B2
(45) Date of Patent: Jun. 16, 2009

(54) EDGE-TO-EDGE CONNECTOR SYSTEM FOR ELECTRONIC DEVICES

(75) Inventors: Scott S. Duesterhoeft, Etters, PA (US); Christopher G. Daily, Harrisburg, PA (US); Ronald M. Weber, Annville, PA (US); Matthew E. Mostoller, Hummelstown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/751,874

(22) Filed: May 22, 2007

(65) Prior Publication Data

US 2008/0293262 A1 Nov. 27, 2008

(51) Int. Cl.
*H01R 9/09* (2006.01)

(52) U.S. Cl. ..... 439/61

(58) Field of Classification Search ..... 439/61, 439/65, 74, 495

See application file for complete search history.

(56) References Cited

U.S. PATENT DOCUMENTS

| | | | | |
|---|---|---|---|---|
| 5,788,510 | A * | 8/1998 | Walker | 439/61 |
| 6,147,871 | A * | 11/2000 | DeWitt et al. | 361/752 |
| 6,253,266 | B1 * | 6/2001 | Ohanian | 710/301 |
| 6,976,848 | B2 * | 12/2005 | Choi | 439/61 |
| 7,044,745 | B2 * | 5/2006 | Reinhardt et al. | 439/61 |
| 7,045,891 | B2 * | 5/2006 | Choi | 257/723 |

* cited by examiner

*Primary Examiner*—Gary F. Paumen

(57) ABSTRACT

A connector apparatus for connecting at least two electronic component substrates, e.g., printed circuit boards or flex circuits, to one another at the edges thereof, wherein each of the at least two substrates further comprises at least one electrically conductive contact surface, and wherein the connector apparatus further includes: at least one electrically conductive transverse conducting member, wherein a first portion of the at least one transverse conducting member physically touches the contact surface on the first substrate, and wherein a second portion of the transverse conducting member physically touches the contact surface on the second substrate; and mechanical means for securing the at least one transverse conducting member to each of the substrates and to each of the contact surfaces.

25 Claims, 19 Drawing Sheets

EDGE-TO-EDGE CONNECTOR SYSTEM FOR ELECTRONIC DEVICES

BACKGROUND OF THE INVENTION

The described invention relates in general to a connector system for use with electronic devices, and more specifically to a connector system for connecting printed circuit boards, flex circuits, or other devices to one another at the edges thereof.

In electronics, printed circuit boards (PCBs) are used to mechanically support and electrically connect electronic components using conductive pathways etched from copper sheets laminated onto a non-conductive substrate. Alternative names for such devices include printed wiring boards (PWB) or etched wiring boards. After populating a PCB substrate with electronic components, a printed circuit assembly (PCA) is formed. PCBs are rugged, inexpensive, and can be highly reliable. PCBs require much more layout effort and higher initial cost than either wire-wrapped or point-to-point constructed circuits, but are typically much cheaper, faster, and consistent in high-volume production. PCBs are widely used in the electronics industry in a variety of products including computers, servers, televisions and telecommunication devices.

The use of multiple, interconnected PCBs, which are stacked or otherwise arranged is not uncommon in the electronics industry. However, existing connectors typically cannot accommodate two opposing printed circuit boards or other devices that are positioned adjacent to one another. Furthermore, existing connectors may not hold circuit boards together in a manner that is secure or stable enough for certain applications such as, for example, avionics. Thus, there is an ongoing need for a connector system that is compatible with thin printed circuit boards, flex circuits, and other similar devices, and that allows stable, end-to-end or edge-to-edge connections between boards.

SUMMARY OF THE INVENTION

The following provides a summary of exemplary embodiments of the present invention. This summary is not an extensive overview and is not intended to identify key or critical aspects or elements of the present invention or to delineate its scope. The present invention provides a connector apparatus that mates the edges of two PCBs, flex circuits, or other electronics devices to form a "chain" of component substrates connected end to end; thereby permitting bussing interconnection between adjacent boards, flex circuits, or other component substrates. A single contact permits connection of the same circuit across and through multiple component substrates. Circuit boards connected in this manner may be stackable (end to end) for various applications and a mechanical locking feature may be integrated into the connector apparatus.

In accordance with one aspect of the present invention, a connector system for use with electronic devices is provided. This system includes: at least two electronic component substrates (e.g., PCBs or flex circuits), wherein each of the at least two substrates further comprises at least one electrically conductive contact surface (i.e., a trace); and at least one connector apparatus for connecting the at least two substrates to one another at the edges thereof, wherein the at least one connector apparatus enables electrical communication between the at least two substrates. The connector apparatus further includes at least one electrically conductive transverse conducting member, wherein a first portion of the transverse conducting member physically contacts the contact surface on the first substrate, and wherein a second portion of the transverse conducting member physically contacts the contact surface on the second substrate; and mechanical means for locking or otherwise securing the at least one transverse conducting member to each of the substrates and to each of the contact surfaces.

In accordance with another aspect of the present invention, a connector for use with circuit boards, flex circuits, or other electronic component substrates is provided. Each of the component substrates further includes at least one electrically conductive contact surface and the connector includes a connector apparatus for connecting the at least two substrates to one another at the edges thereof and enabling electrical communication therebetween. The connector apparatus further includes: (i) at least one electrically conductive transverse conducting member, wherein a first portion of the at least one transverse conducting member physically contacts the contact surface on the first substrate, and wherein a second portion of the transverse conducting member physically contacts the contact surface on the second substrate; and (ii) mechanical means for securing the at least one transverse conducting member to each of the substrates and to each of the contact surfaces.

In yet another aspect of this invention, a method for connecting printed circuit boards, flex circuits, or other electronics devices to one another is provided. This method includes: providing at least two printed circuit boards (or other electronic component substrates), wherein each of the at least two printed circuit boards further comprises a substantially planar contact surface (i.e., a trace), which may be substantially rigid, or which may be flexible; providing at least one connector apparatus for connecting the at least two printed circuit boards to one another at the edges thereof, wherein the at least one connector apparatus enables electrical communication between the at least two printed circuit boards. The connector apparatus further includes: at least one transverse conducting member, wherein a first portion of the at least one transverse conducting member touches or otherwise contacts the substantially planar contact surface on the first printed circuit board, and wherein a second portion of the transverse conducting member touches or otherwise contacts the substantially planar contact surface on the second printed circuit board; and locking means for securing the at least one transverse conducting member to each of the printed circuit boards and to each of the substantially planar contact surfaces; and electrically connecting the at least two printed circuit boards to one another by contacting the at least one transverse conducting member with the substantially planar contact surfaces on each printed circuit board; and physically connecting the at least two printed circuit boards to one another by engaging the locking means.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1A:
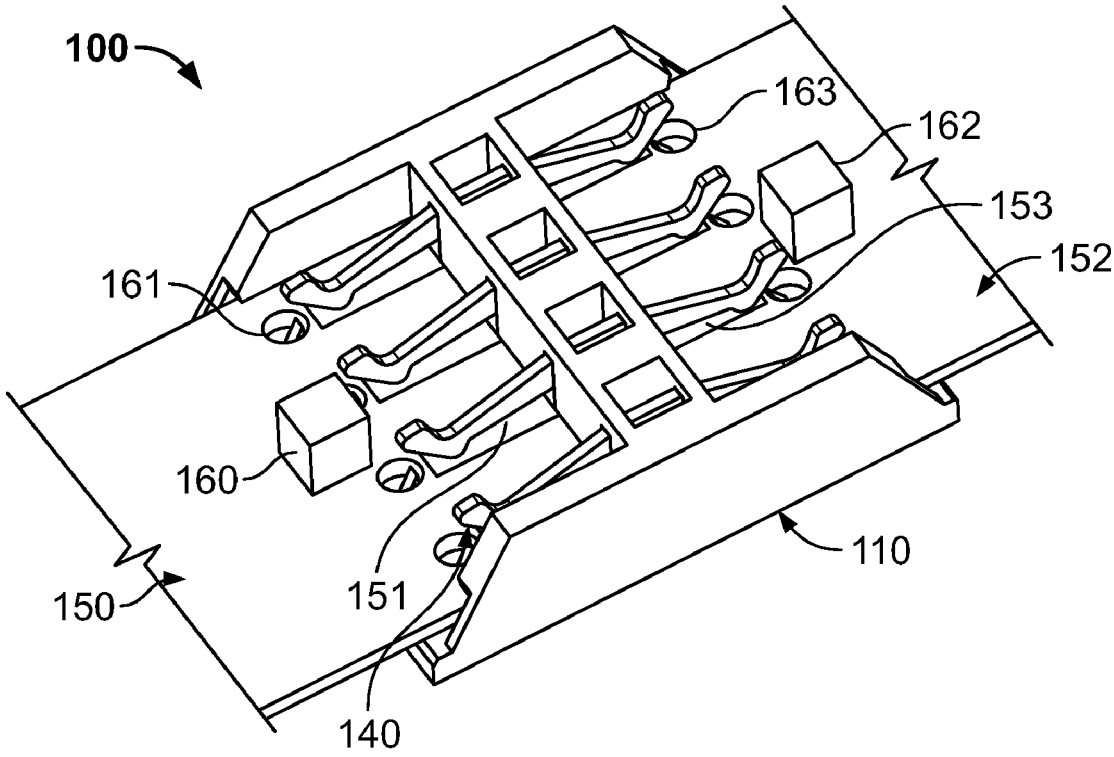
FIG. 1A is a top perspective view of a first exemplary embodiment of the connector system of the present invention shown connecting two printed circuit boards at the edges thereof.
Figure 1B:
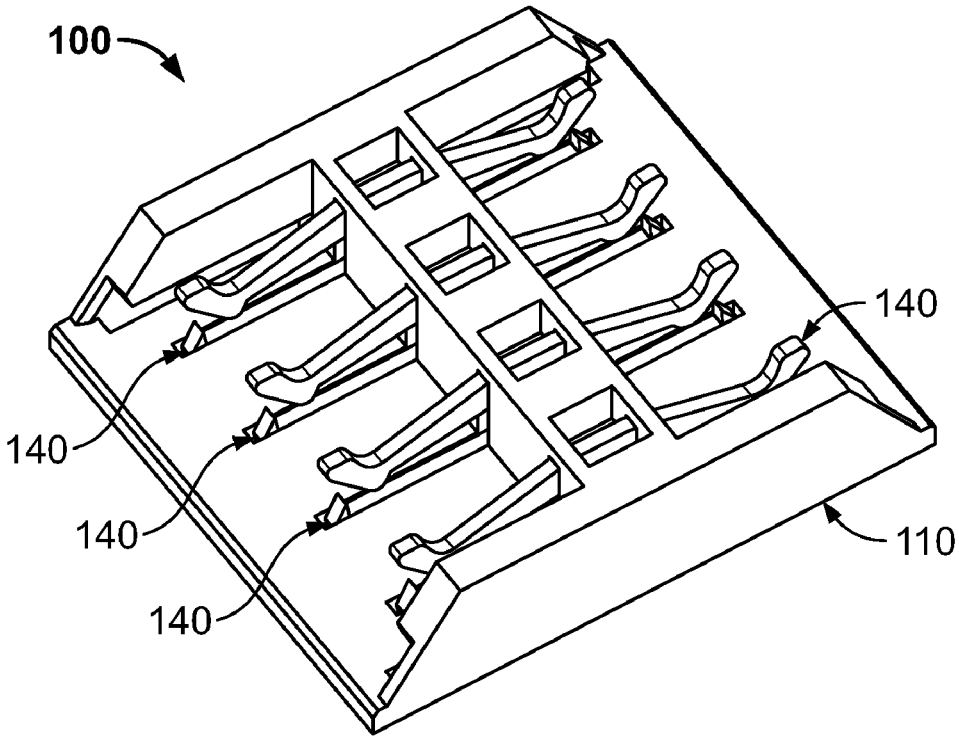
FIG. 1B is a top perspective view of the connector system of FIG. 1A shown without the printed circuit boards.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

The present invention relates to systems and devices for connecting electronic components to one another. An exemplary embodiment of this invention provides a connector system for use with electronic devices and for enabling electrical communication between such devices. A first general embodiment provides a system for connecting at least two component substrates to one another at the edges thereof, a second general embodiment provides a connector for use with at least two electronic component substrates; and a third general embodiment provides a method for connecting multiple component substrates to one another and enabling electronic communication therebetween. With reference now to the Figures, one or more specific embodiments of this invention shall be described in greater detail.

Figure 1C:
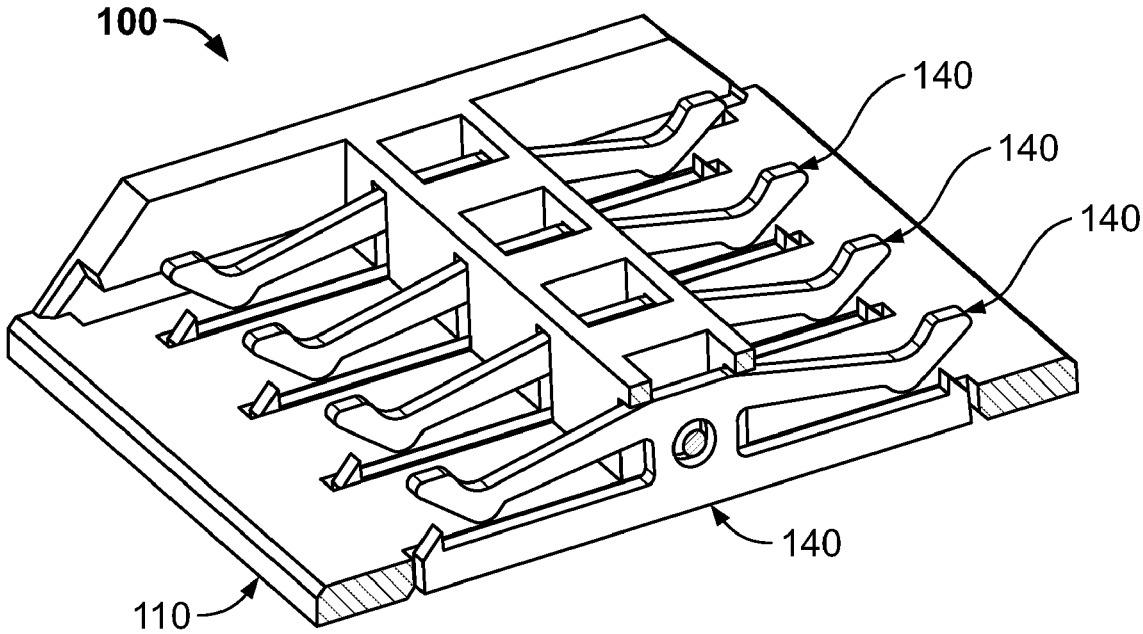
FIG. 1C is a cutaway top perspective view of the connector system of FIG. 1A.
Figure 1D:
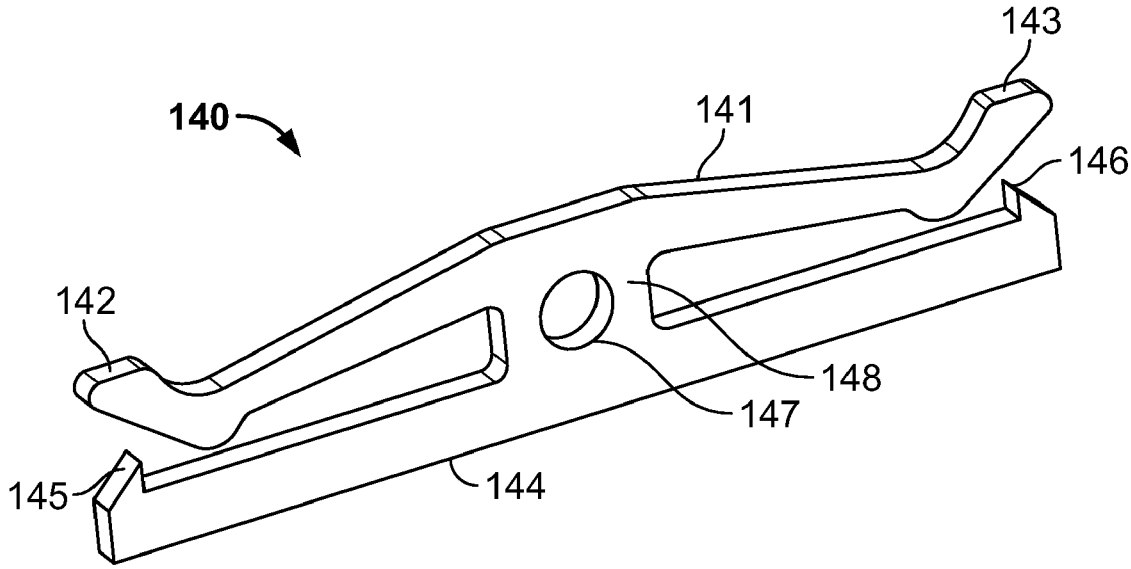
FIG. 1D is a front perspective view of one of the individual transverse conducting members of the connector system of FIG. 1A.
Figure 1E:
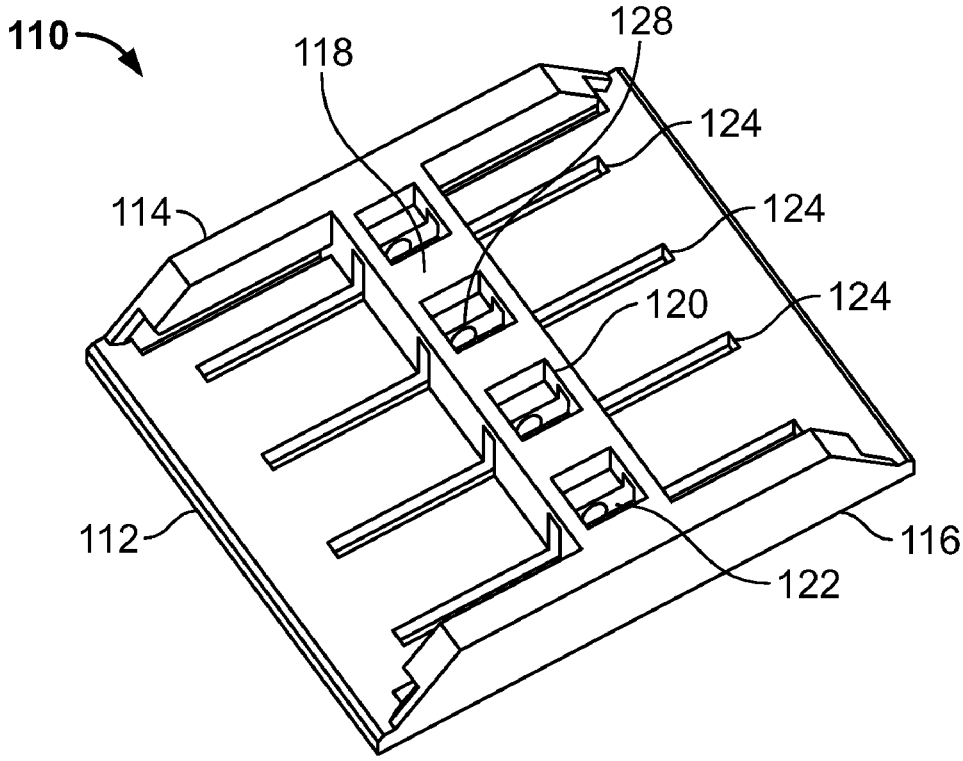
FIG. 1E is a top perspective view of the housing component of the connector system of FIG. 1A.
Figure 1F:
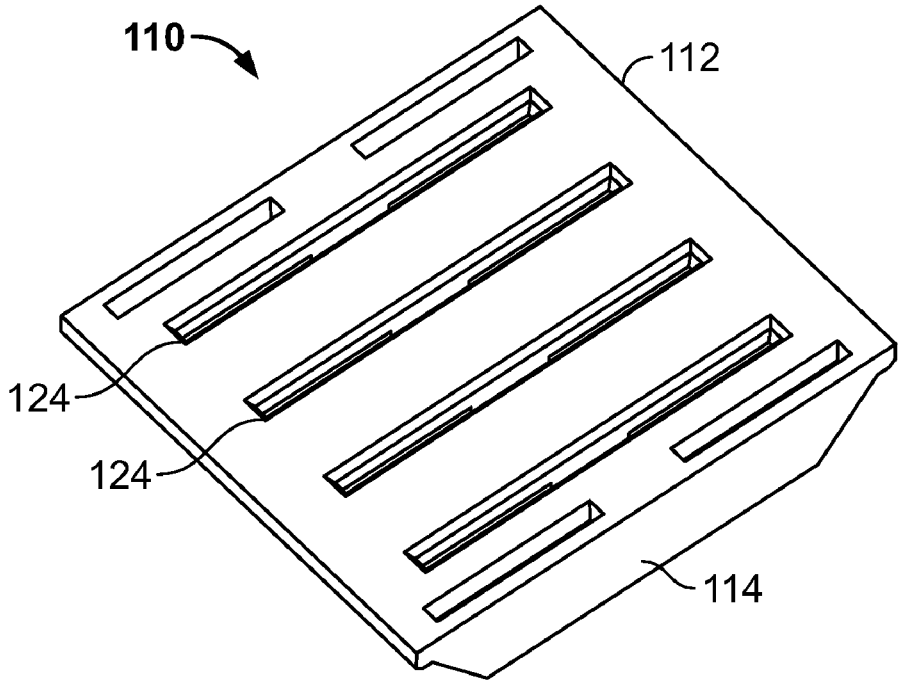
FIG. 1F is a bottom perspective view of the housing component of the connector system of FIG. 1A.

With reference now to the Figures, FIGS. 1A-1F provide various views of a first exemplary embodiment of the connector system of present invention. In these Figures, connector apparatus 100 includes a housing component 110 in which a plurality of electrically conductive transverse conducting members 140 are mounted. Housing 110 is typically a dielectric material or other substantially non-conductive material and may include ABS plastic or other suitable materials. As best shown in FIGS. 1L-1F, housing component 110 includes base 112, first retaining member 114 and second retaining member 116 (which generally serve as guides for inserting printed circuit boards 150 and 152 into the housing), and center portion 118. A plurality of slots 124 are also formed in base 112. Center portion 118 further includes a plurality of cavities 124 formed therein, and within each cavity a seat 122 is formed. Each seat 122 includes a protrusion 128 formed on a portion thereof.

As best shown in FIGS. 1C and 1D, each transverse conducting member 140 mounted in housing 110 includes an upper portion 141 and a lower portion 144. Each transverse conducting member 140 also typically includes copper, copper alloy, brass, silver, gold, platinum, iridium, or another suitably conductive material or combinations of materials. Upper portion 141 includes first upper portion terminus 142 and second upper portion terminus 143 and lower portion 144 includes first lower portion terminus 145 and second lower portion terminus 146. A hook-like structure is formed at each lower portion terminus. Aperture 147 is formed center portion 148, which is located between upper portion 141 and lower portion 144. As shown in FIG. 1D, the regions of upper portion 141 located between center portion 148 and each upper portion terminus, angle slightly downward toward lower portion 144. When a transverse conducting member 140 is mounted within housing component 110, the lower portion 144 extends through one of the slots 124, and protrusion 128 engages aperture 147 to prevent or at least limit any unwanted movement of the transverse conducting member within the housing component.

With reference to FIG. 1A, first PCB 150 includes a first device component, e.g., LED 160, a plurality of traces, referred to herein as "substantially planar contact plates or surfaces" 151, and a plurality of apertures 161, which are formed in and pass through the material of PCB 150. Likewise, second PCB 152 includes a second device component, e.g., LED 162, a plurality of substantially planar contact plates or surfaces (i.e., traces) 153, and a plurality of apertures 163, which are formed in and pass through the material of PCB 152.

To properly use connector apparatus 100, first PCB 150 is inserted into housing component 110 until each first lower portion terminus 145 fully engages the corresponding aperture 161 formed in the first PCB (see FIG. 1A). Similarly, second PCB 152 is inserted into housing component 110 until each second lower portion terminus 146 fully engages the corresponding aperture 163 formed in the PCB (see FIG. 1A). The downward biasing of each side of upper portion 141 on transverse conducting member 140 allows upper portion terminus 142 and 143 to make secure contact with contact surfaces (i.e., traces) 151 and 153 respectively. The combination of the downward bias of the upper portion of transverse conducting member 140 and the hook-like structures formed at each lower portion terminus create a locking means that secures each PCB in connector apparatus 100 and the securely attaches the two boards to one another. Retaining members 114 and 116 add stability to the assembly once the boards are connected. Once the PCBs are fully inserted into connector apparatus 100, transverse conducting members 140 physically contact planar contact surfaces 151 and 153 and create a series of completed circuits for enabling electrical communication between the PCBs.

Figure 2A:
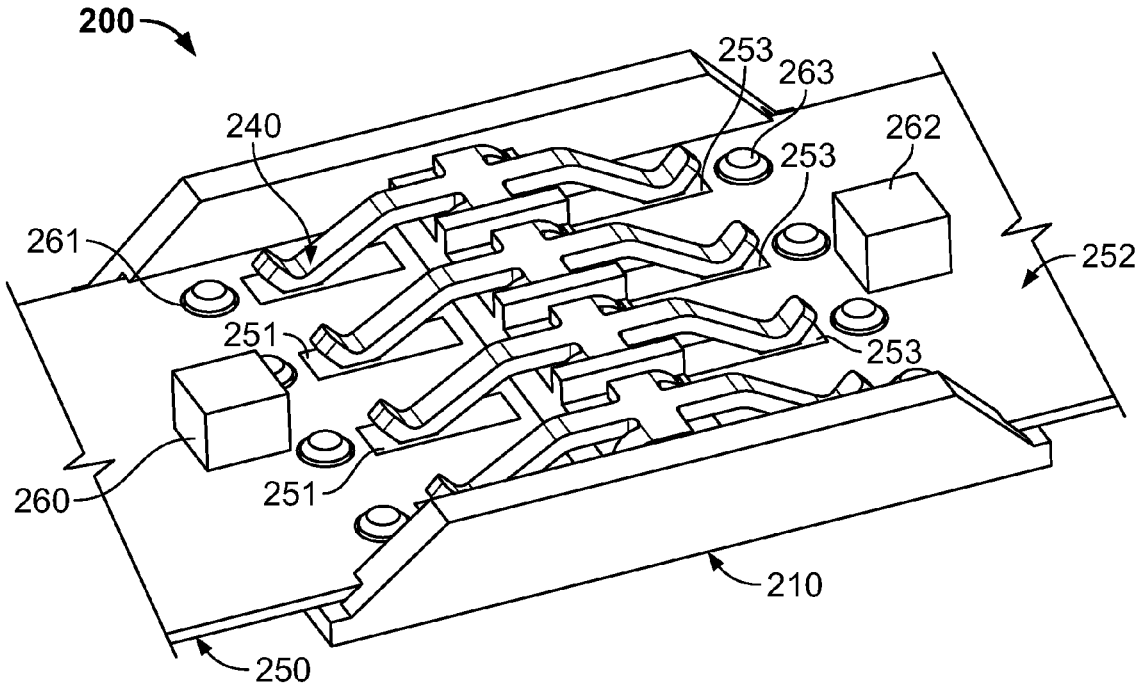
FIG. 2A is a top perspective view of a second exemplary embodiment of the connector system of the present invention shown connecting two printed circuit boards at the edges thereof.
Figure 2B:
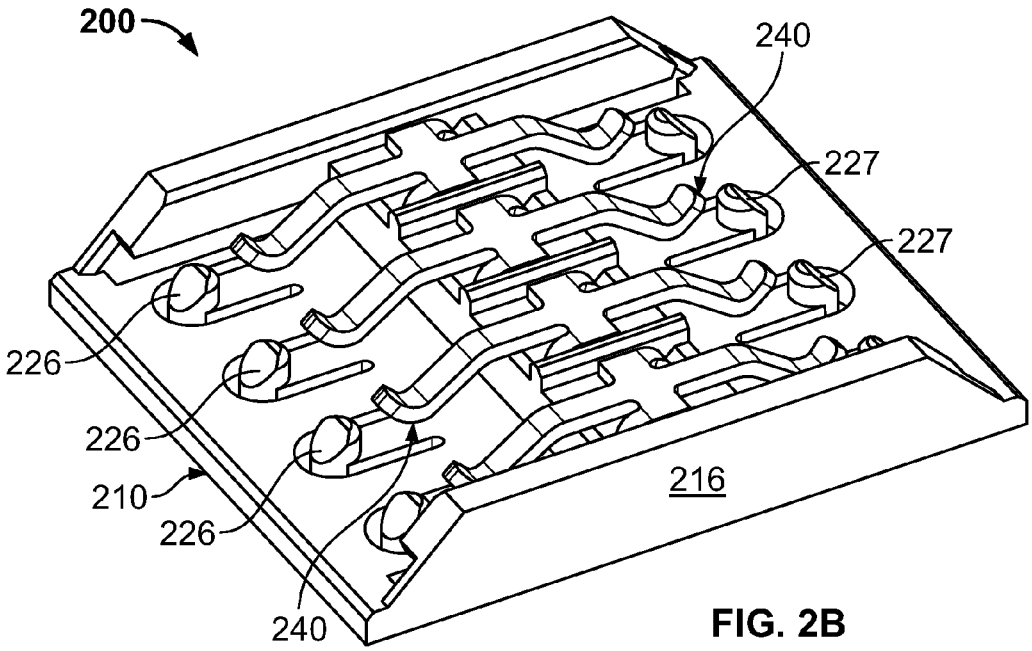
FIG. 2B is a top perspective view of the connector system of FIG. 2A shown without the printed circuit boards.
Figure 2C:
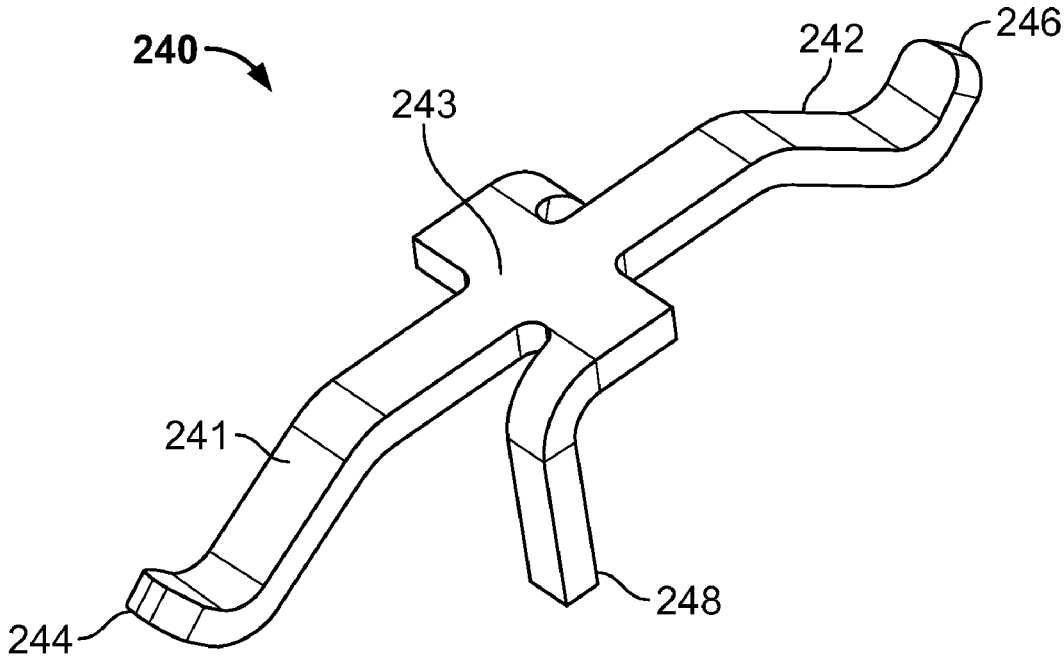
FIG. 2C is a top perspective view of one of the individual transverse conducting members of the connector system of FIG. 2A.
Figure 2D:
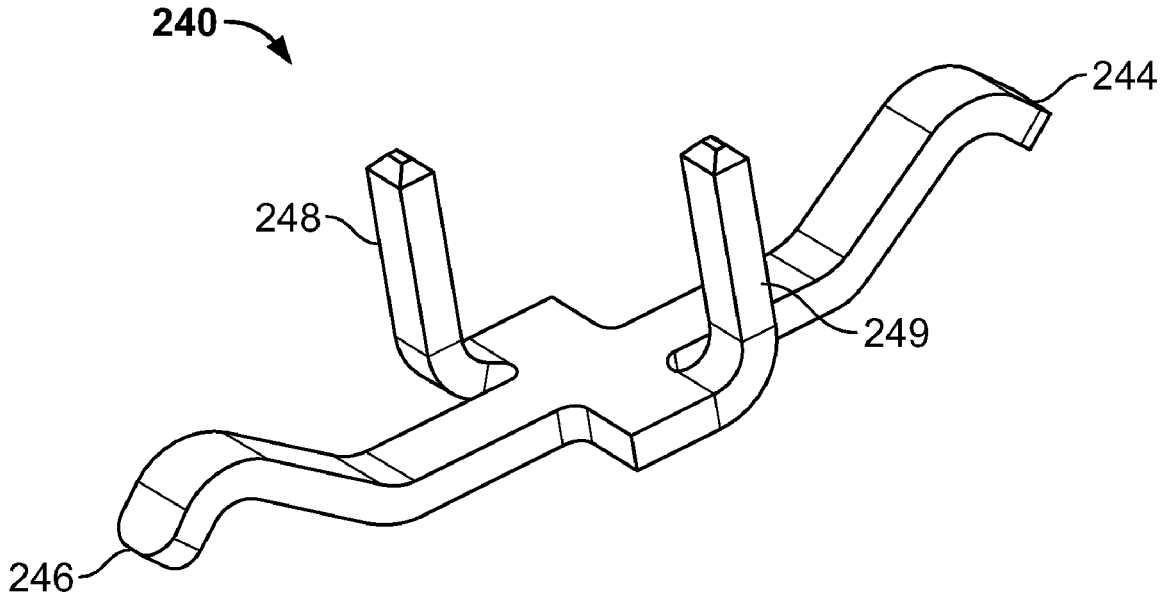
FIG. 2D is a bottom perspective view of one of the individual transverse conducting members of the connector system of FIG. 2A.
Figure 2E:
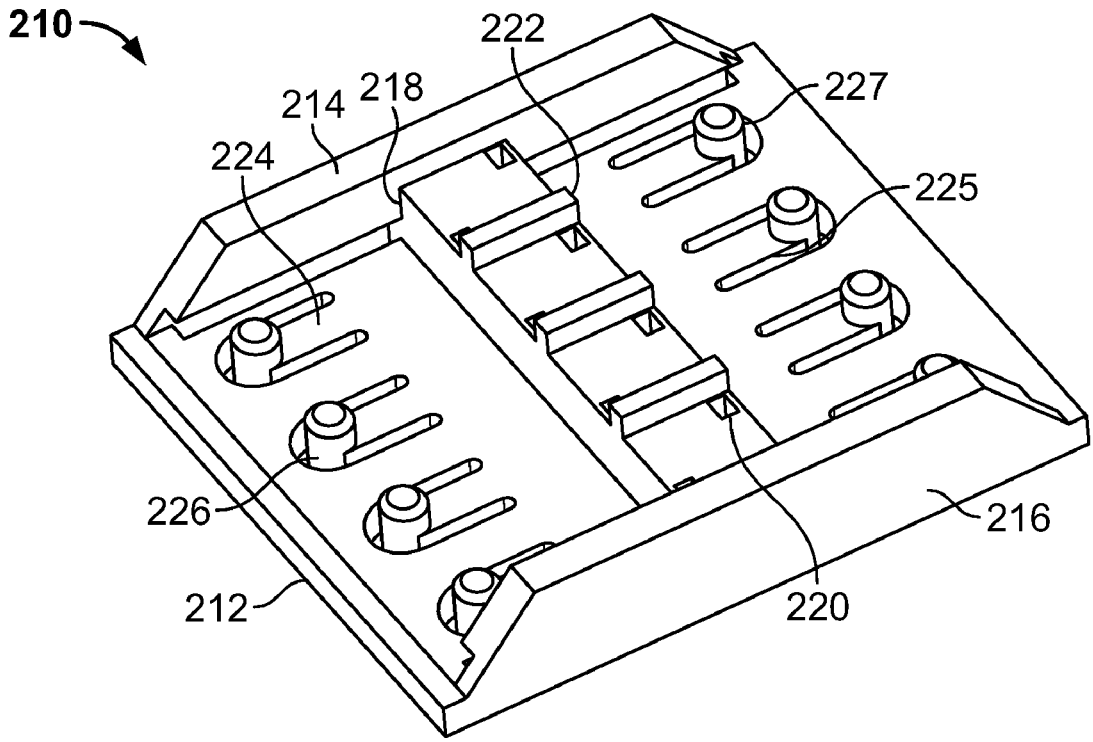
FIG. 2E is a top perspective view of the housing component of the connector system of FIG. 2A.
Figure 2F:
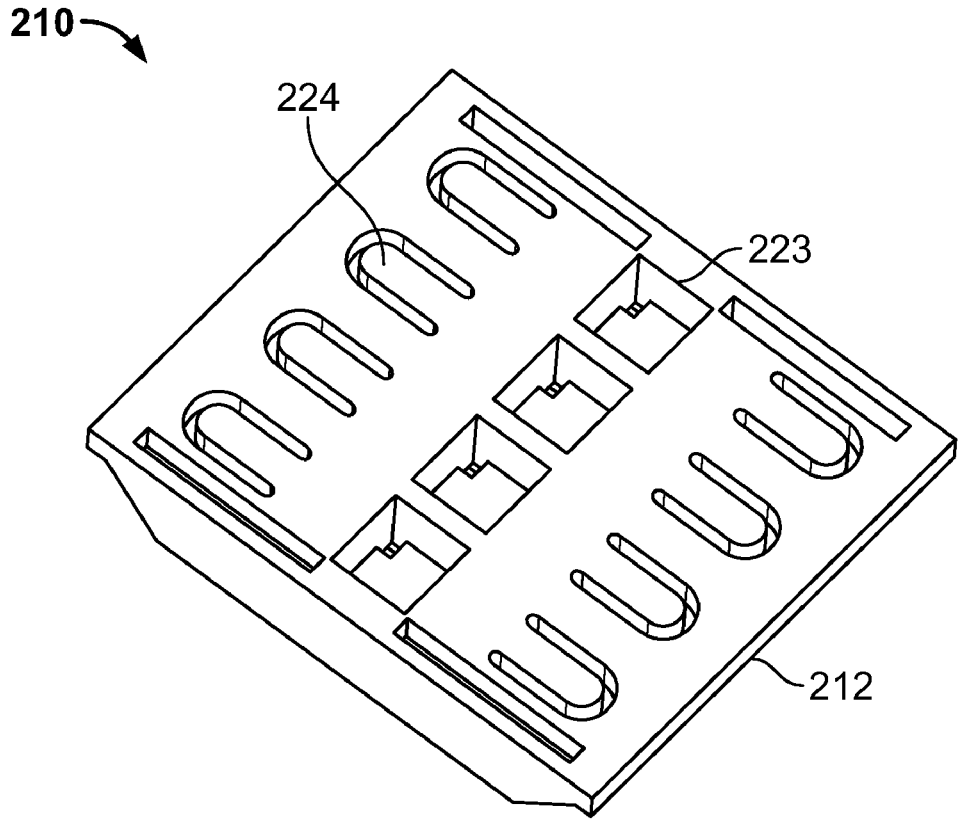
FIG. 2F is a bottom perspective view of the housing component of the connector of FIG. 2A.

FIGS. 2A-2G provide various views of a second exemplary embodiment of the connector system of present invention. In these Figures, connector apparatus 200 includes a housing component 210 in which a plurality of transverse conducting members 240 are mounted. Housing 210 is typically a dielectric material or other substantially non-conductive material and may include ABS plastic or other suitable material. As best shown in FIGS. 2E-2F, housing component 210 includes base 212, which further includes first retaining member 214 and a second retaining member 216 (which generally serve as guides for inserting printed circuit boards 250 and 252 into the housing), and center portion 218. Center portion 218 further includes a plurality of top housing cavities 220, which are separated by ridges 222, and a plurality of bottom housing cavities 223. A plurality of locking members 224 are formed on each side of base 212, and each locking member 224 terminates in an upwardly facing peg 226, the top surface of which may be angled or slanted.

Figure 2G:
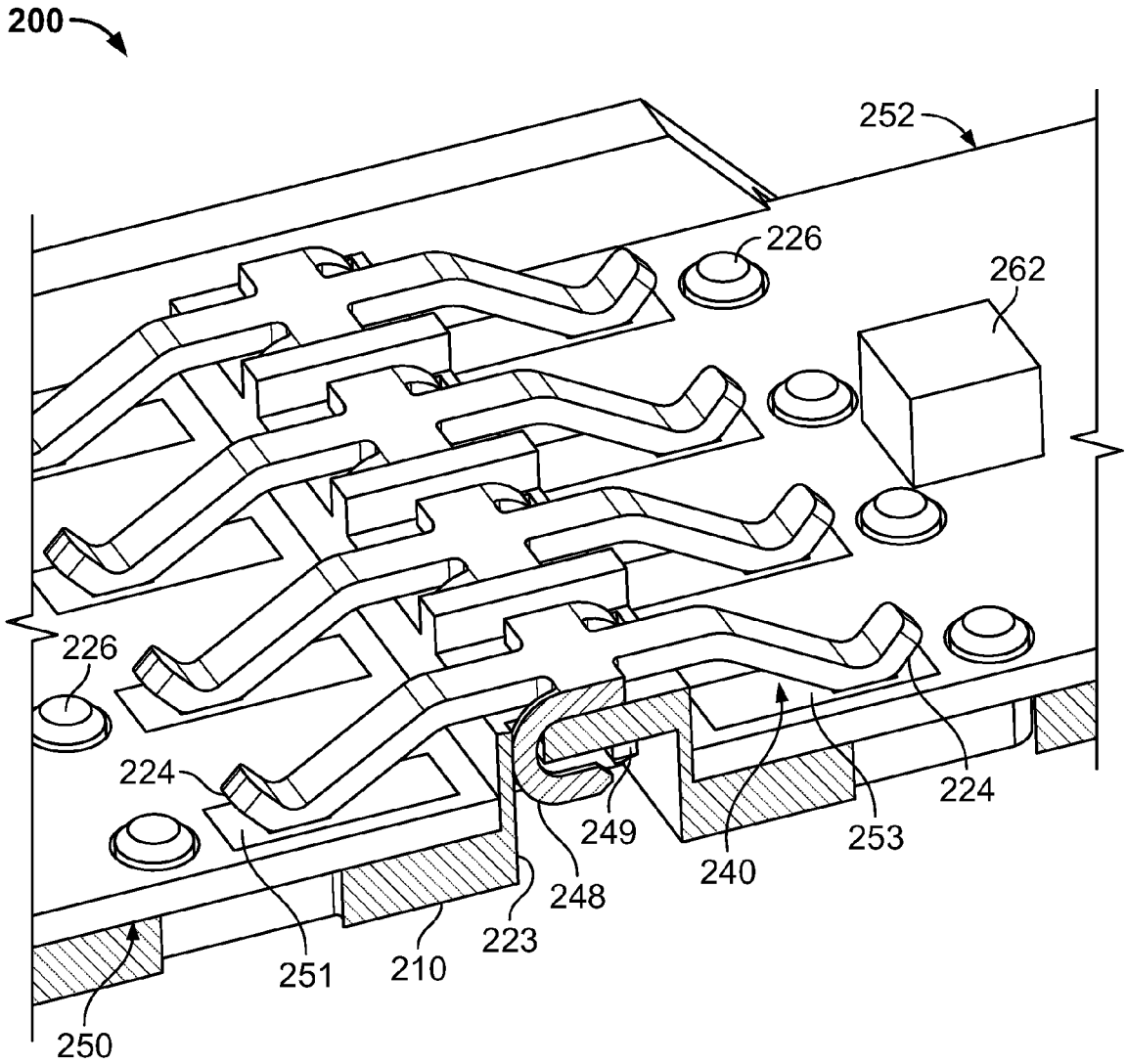
FIG. 2G is a cutaway top perspective view of the connector system of FIG. 2A showing a portion of an individual transverse conducting member bent around a portion of the housing component to secure the contact member therein.

As best shown in FIGS. 2C and 2D, each electrically conductive transverse conducting member 240 mounted in housing 210 includes a first arm 241, which includes first terminus 244 and a second arm 242 which include includes second terminus 246. Both arms are angled or biased in a downward direction. Formed integrally with middle portion 242 of transverse conducting member 240 are first leg 248 and second leg 249. Each transverse conducting member 240 also typically includes copper, copper alloy, brass, silver, gold, platinum, iridium, or another suitably conductive material or combinations of materials. When a transverse conducting member 240 is mounted within housing component 210, middle portion 243 rests on center portion 218, and first and second legs 248 and 249 are inserted into top housing cavities 220. As shown in FIG. 2G, a transverse conducting member 240 is secured within housing 210 by bending or deforming legs 248 and 249 within bottom housing cavity 223. Securing each transverse conducting member 240 in this manner prevents or at least limits any unwanted movement of the transverse conducting member within the housing component. Transverse conducting members 240 may be manufactured by stamping and forming the piece into the desired shape.

With reference to FIG. 2A, first PCB 250 includes a first device component, e.g., LED 260, a plurality of traces, referred to herein as "substantially planar contact plates" or surfaces 251, and a plurality of apertures 261, which are formed in and pass through the material of first PCB 250. Likewise, second PCB 252 includes a second device component, e.g., LED 262, a plurality of substantially planar contact plates or surfaces (i.e., traces) 253, and a plurality of apertures 263, which are formed in and pass through the material of second PCB 252.

To properly use connector apparatus 200, first PCB 250 is inserted into housing component 210 until the pegs 226 at the end of the locking members 224 fully engage the corresponding apertures 261 formed in the first PCB (see FIG. 2A). Similarly, second PCB 252 is inserted into the other side of housing component 210 until pegs 227 at the end of locking members 225 fully engage the corresponding apertures 263 formed in the second PCB (see FIG. 2A). The downward biasing of each arm 241 and 242 on transverse conducting member 240 allows terminus 244 and terminus 246 to make secure contact with contact surfaces 251 and 253 respectively. The combination of the downward bias of arms 241 and 242 and the pegs 226 and 227 on the housing create a locking means that secures each PCB in connector apparatus 200 and the secures the two boards to one another. Retaining members 214 and 216 add stability to the assembly once the boards are connected. Once the PCBs are fully inserted into connector apparatus 200, transverse conducting members 240 physically contact the planar surfaces 251 and 253 and create a series of completed circuits for enabling electrical communication between the PCBs. Advantageously, the second exemplary embodiment of this invention provides a connector system that does not include transverse conducting members on the bottom side of the housing component. This configuration makes this embodiment particularly useful with clad aluminum printed circuit boards and the like.

Figure 3A:
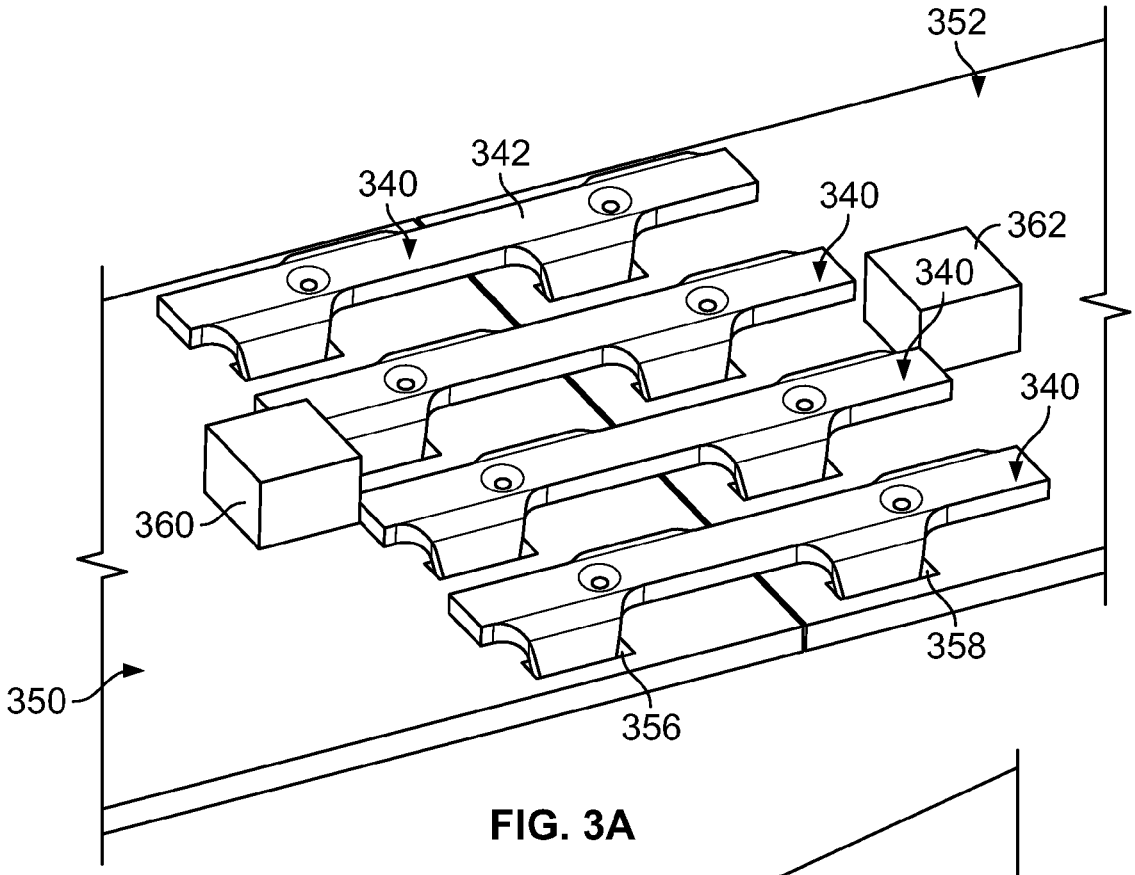
FIG. 3A is top perspective view of a third exemplary embodiment of the connector system of the present invention shown connecting two printed circuit boards at the edges thereof.
Figure 3B:
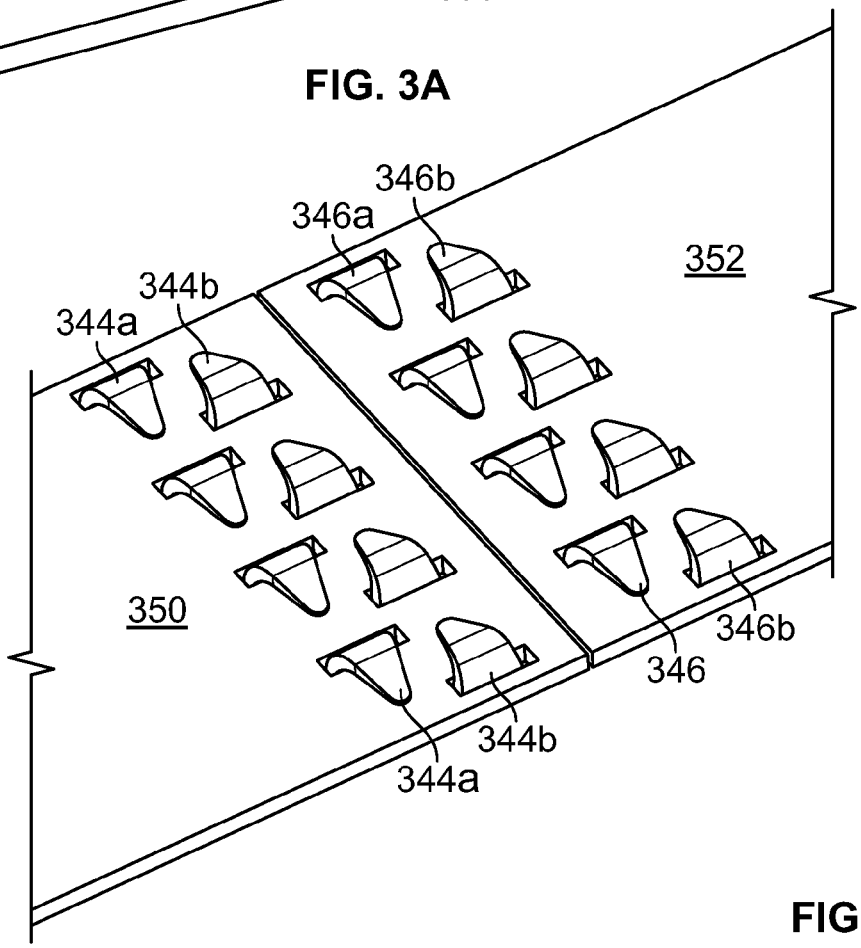
FIG. 3B is bottom perspective view of the connector system of FIG. 3A.
Figure 3C:
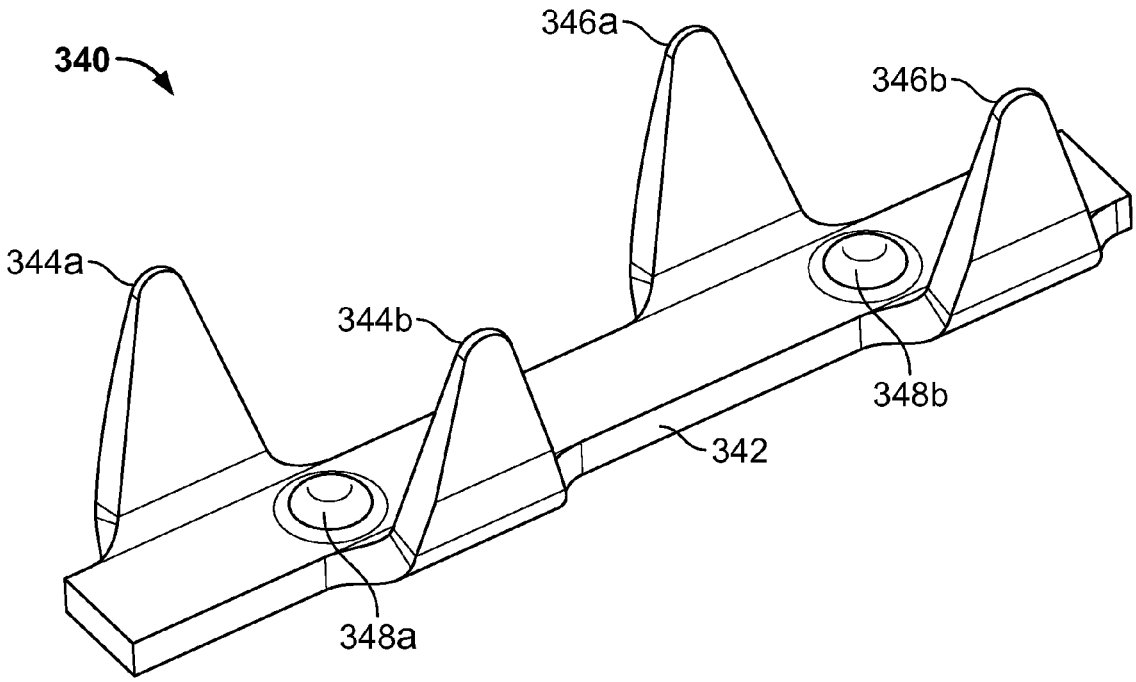
FIG. 3C is a top perspective view of one of the individual transverse conducting members of the connector system of FIG. 3A.
Figure 3D:
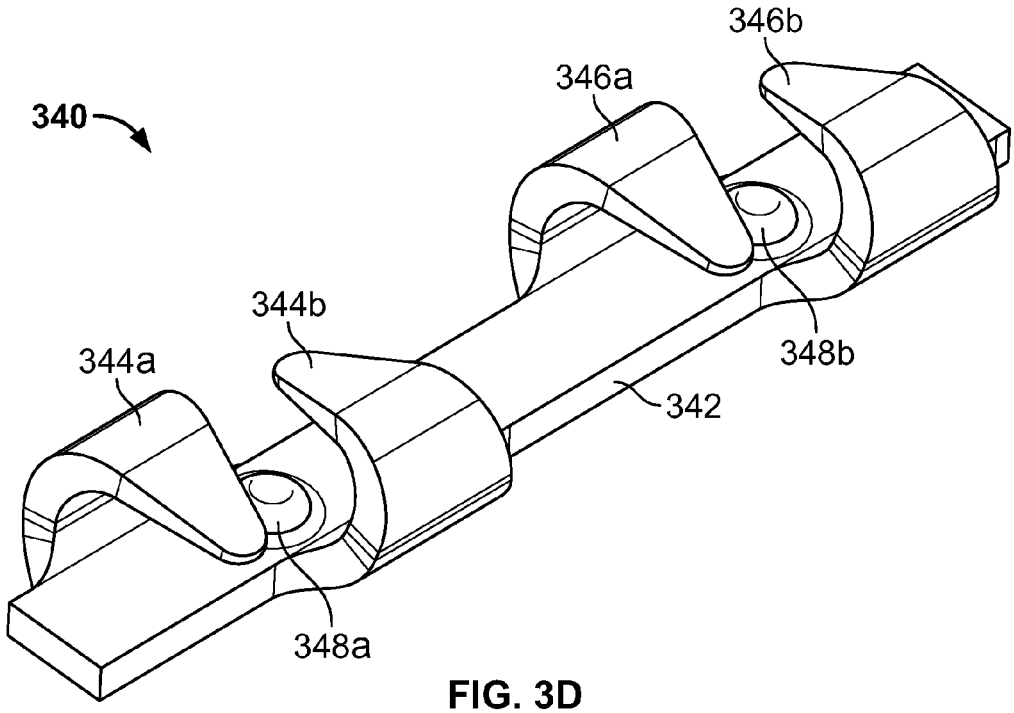
FIG. 3D is a bottom perspective view of one of the individual transverse conducting members of the connector system of FIG. 3A.

FIGS. 3A-3G provide various views of two versions a third exemplary embodiment of the connector system of present invention. In the various versions of this embodiment, a housing component is absent, and multiple printed circuit boards are connected to one another solely by a plurality of transverse conducting members 340. As shown in FIGS. 3C-3D, an electrically conductive transverse conducting member 340 includes an elongated body 342 that further includes first leg 344*a*, second leg 344*b*, third leg 346*a*, and fourth leg 346*b*, as well as first protrusion 348*a* and second protrusion 348*b*. This embodiment is compatible with transverse conducting members having any number of legs. Each transverse conducting member 340 also typically includes copper, copper alloy, brass, silver, gold, platinum, iridium, or another suitably conductive material or combinations of materials.

Figure 3E:
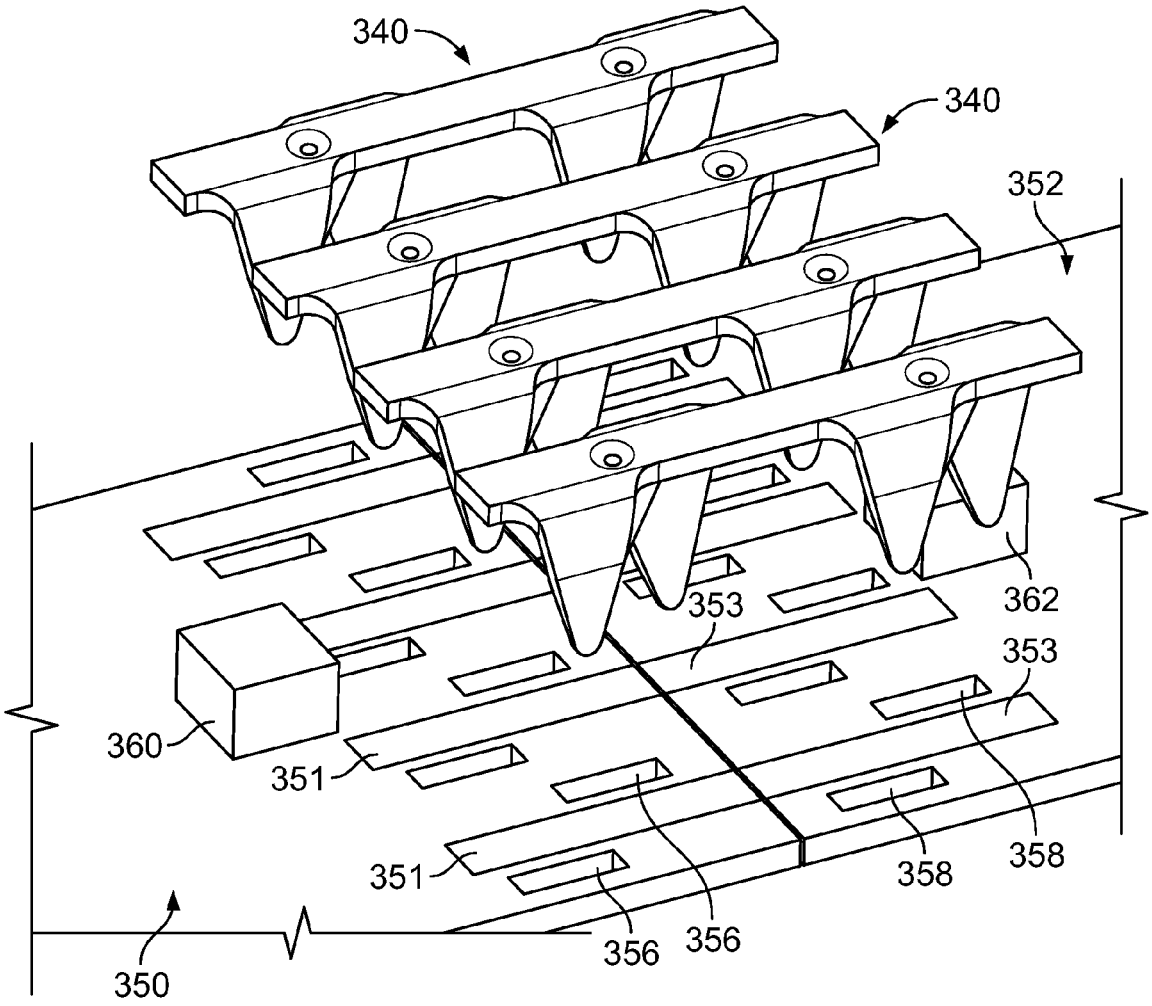
FIG. 3E is an exploded view of the connector system of FIG. 3A showing the individual transverse conducting members removed from the printed circuit boards

With reference to FIGS. 3A and 3E, first PCB 350 includes a first device component, e.g., LED 360, a plurality of traces, referred to herein as "substantially planar contact plates or surfaces" 353, and a plurality of offset (from each other) slots 356, which are formed in and pass through the material of first PCB 350. Likewise, second PCB 352 includes a second device component, e.g., LED 362, a plurality of substantially planar contact plates or surfaces (i.e., traces) 353, and a plurality of offset (from each other) slots 358, which are formed in and pass through the material of second PCB 352.

Figure 3F:
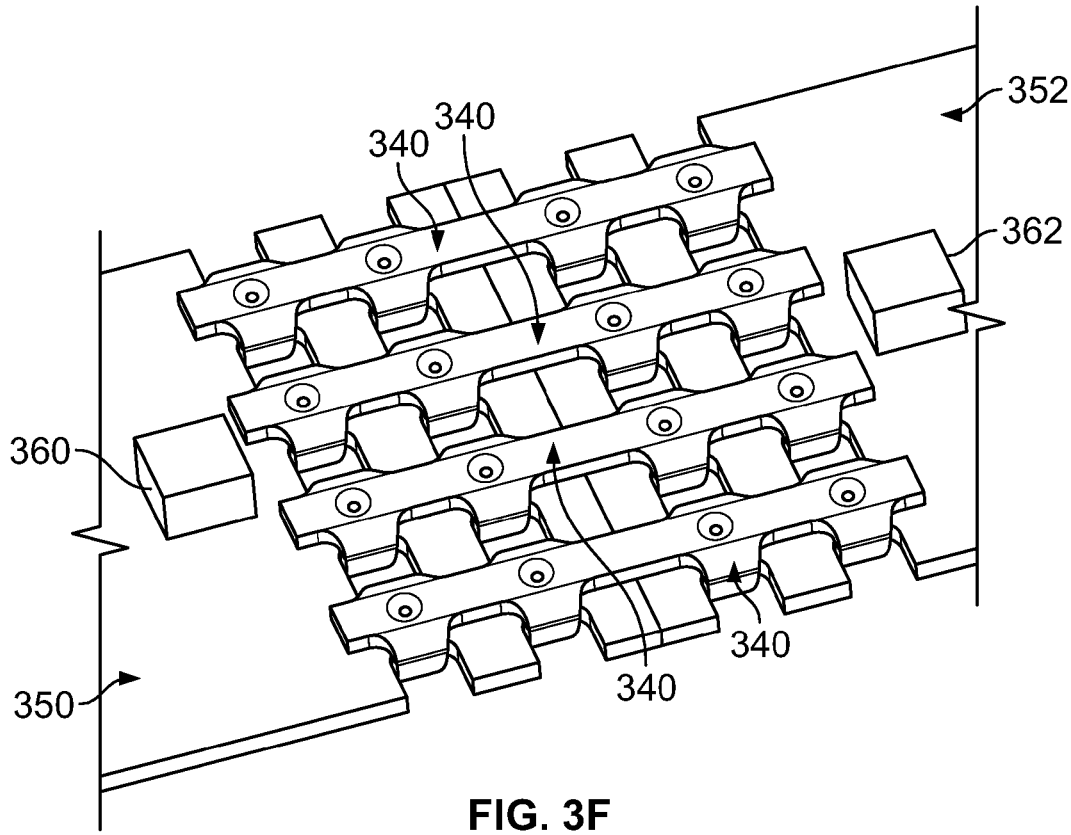
FIG. 3F is a top perspective view of a variant of the third exemplary embodiment of the present invention shown in FIG. 3A, wherein the individual transverse conducting members include additional legs for engaging the printed circuit boards.
Figure 3G:
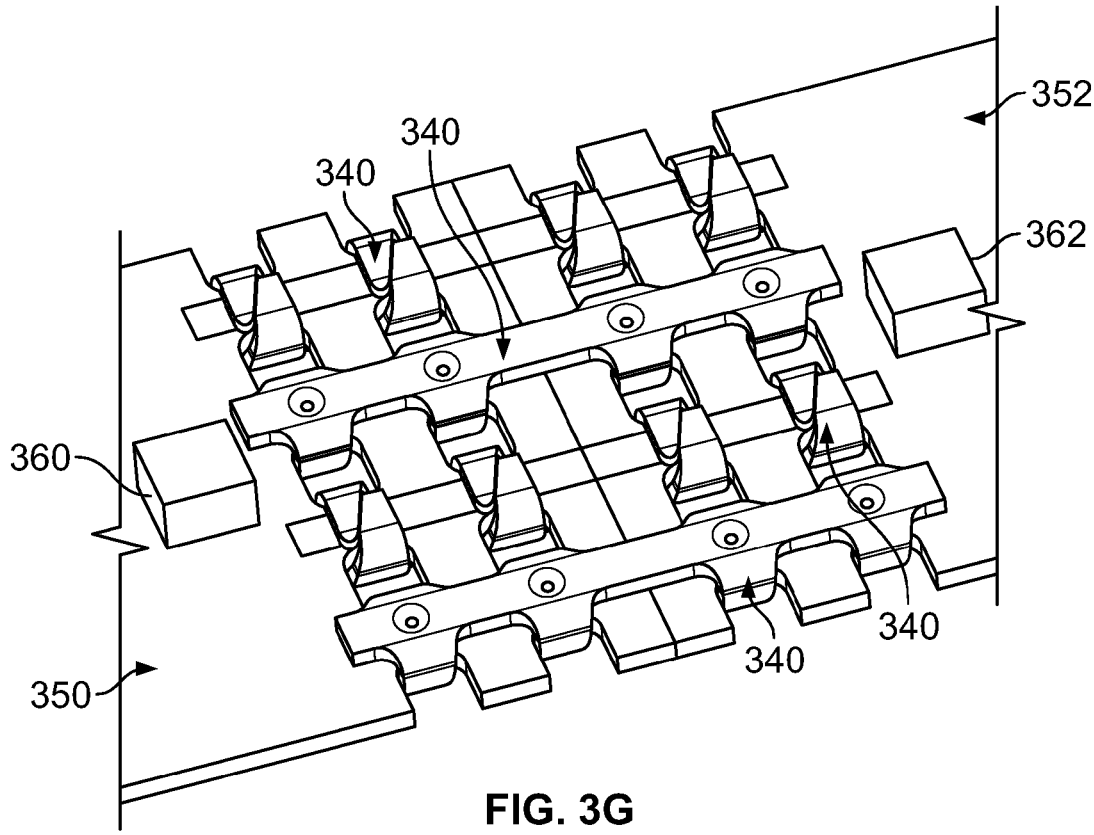
FIG. 3G is a second configuration of the top perspective view of the exemplary embodiment of FIG. 3F.

With reference to FIGS. 3A-B and 3E, in a first version of the third embodiment, transverse conducting members 340 are used to connect multiple PCBs to one another by placing boards to be connected together, inserting deformable legs 344*a-b* and 346*a-b* though slots 356 and 358 respectively until protrusions 348*a* and 348*b* on body 342 touch contact plates (i.e., traces) 351 and 353 respectively, and bending or crimping the ends of the legs as shown in FIG. 3B to secure the transverse conducting member to the PCBs and to secure the PCBs to each other. Once the PCBs are connected in this manner, transverse conducting members 340 create a series of completed circuits for enabling electrical communication between the PCBs. With reference to FIGS. 3F-3G, in a second version of the third embodiment, transverse conducting members 340 include eight (or more) legs rather than four legs and each PCB includes a waffle-like pattern of apertures that replaces the offset slots in the first version described above. The transverse conducting members may be attached to the PCBs in a single orientation as shown in FIG. 3F, or in an alternating upward and downward orientation as shown in FIG. 3G. As with the first version of the third embodiment, once the PCBs are connected using the system of the present invention, transverse conducting members 340 create a series of completed circuits for enabling electrical communication between the PCBs.

Figure 4A:
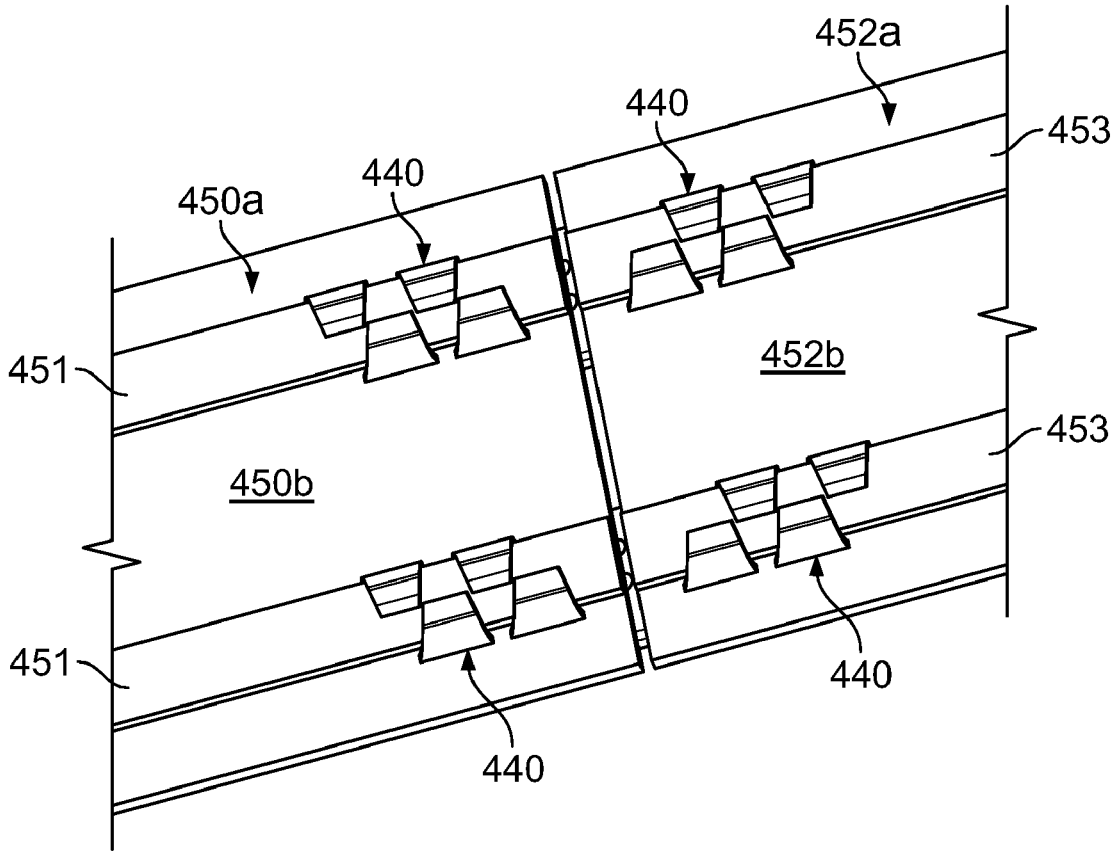
FIG. 4A is top perspective view of a fourth exemplary embodiment of the connector system of the present invention shown connecting two flex circuits at the edges thereof.
Figure 4B:
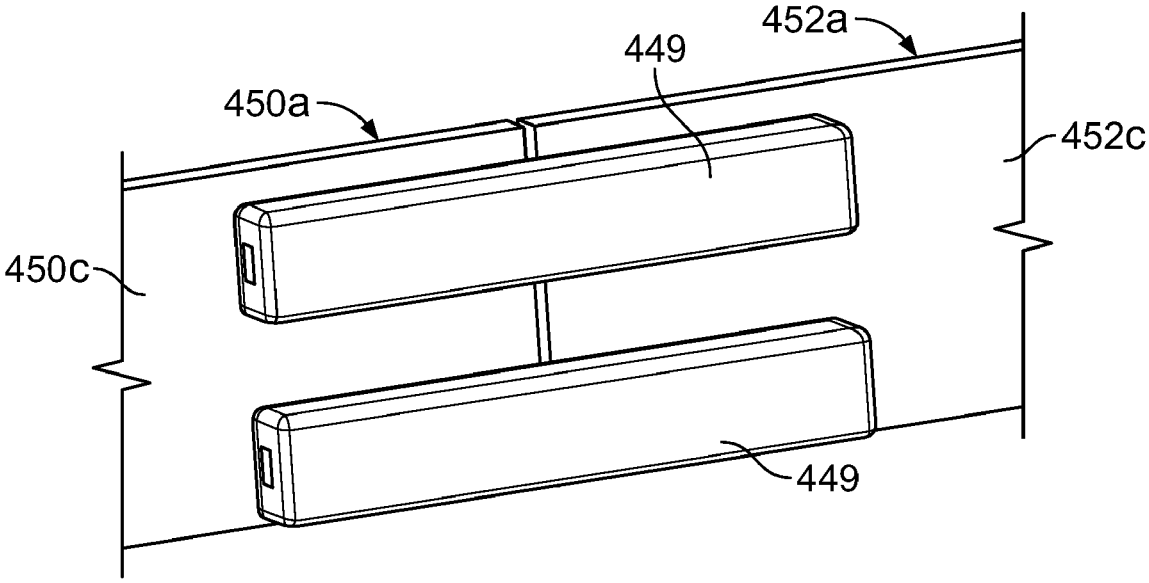
FIG. 4B is a bottom perspective view of the fourth exemplary embodiment of FIG. 4A illustrating the flattened bottom portion of each insulator on the non-conductive side of the flex circuits.
Figure 4C:
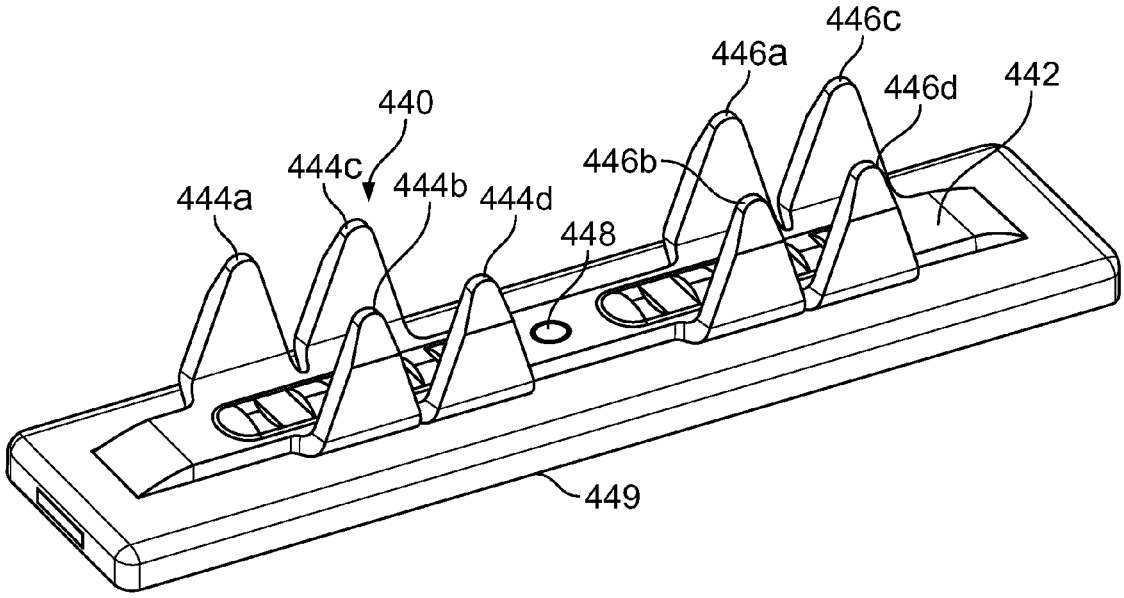
FIG. 4C is a top perspective view of one of the transverse conducting members of the connector system of FIG. 4A.
Figure 4D:
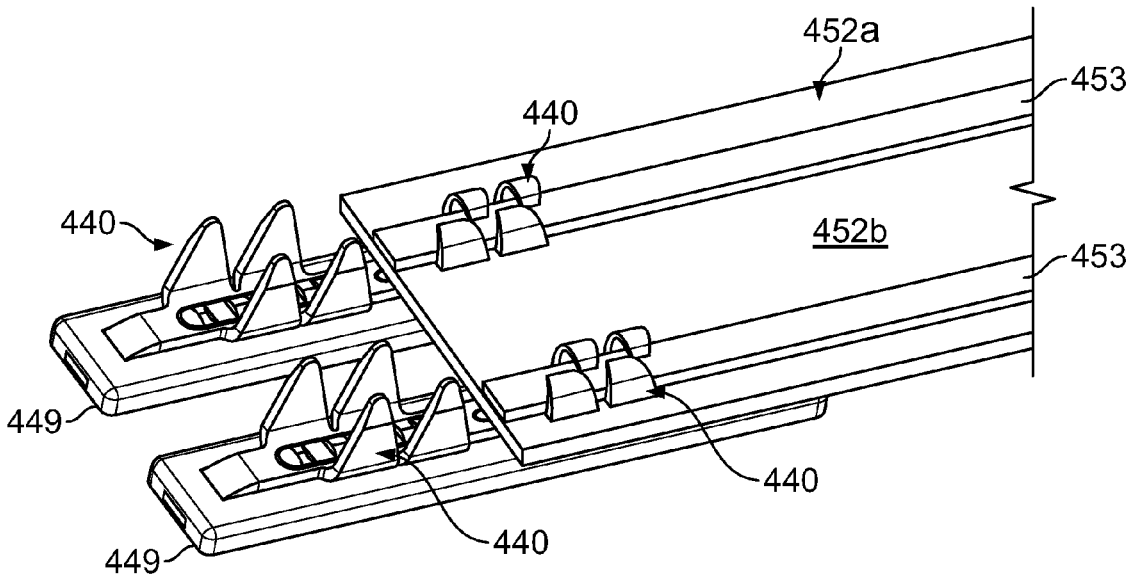
FIG. 4D is a top perspective view of two of the transverse conducting members of the connector system of the present invention attached to a single flex circuit.
Figure 4E:
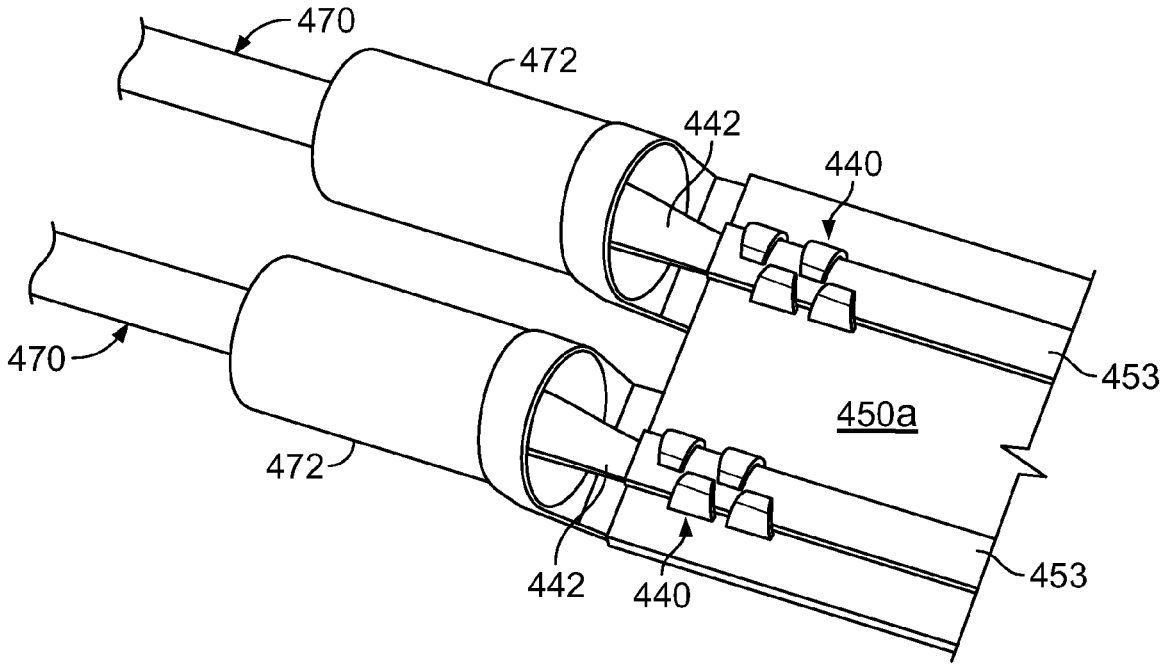
FIGS. 4E-F are top and bottom perspective views respectively of two transverse conducting members of the connector system of the present invention connecting flexible wires to a flexible circuit.
Figure 4F:
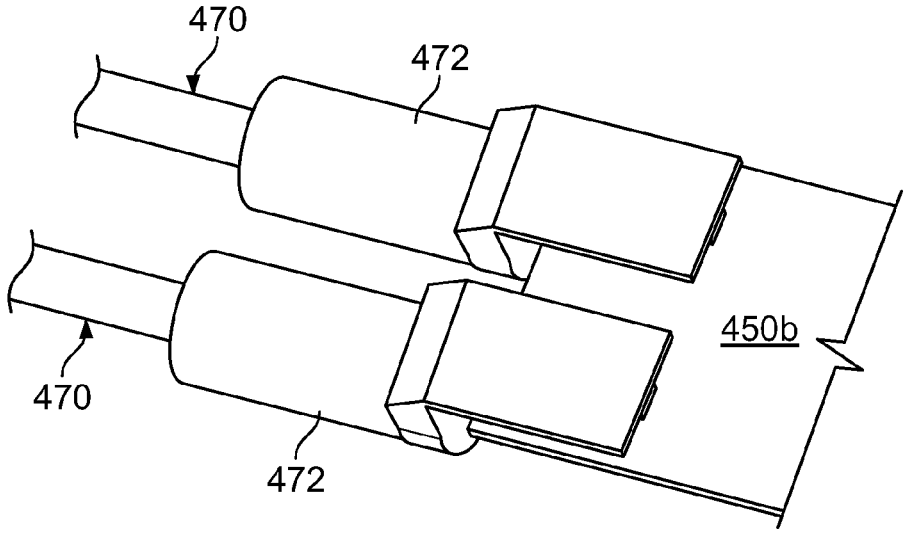
Figure 4G:
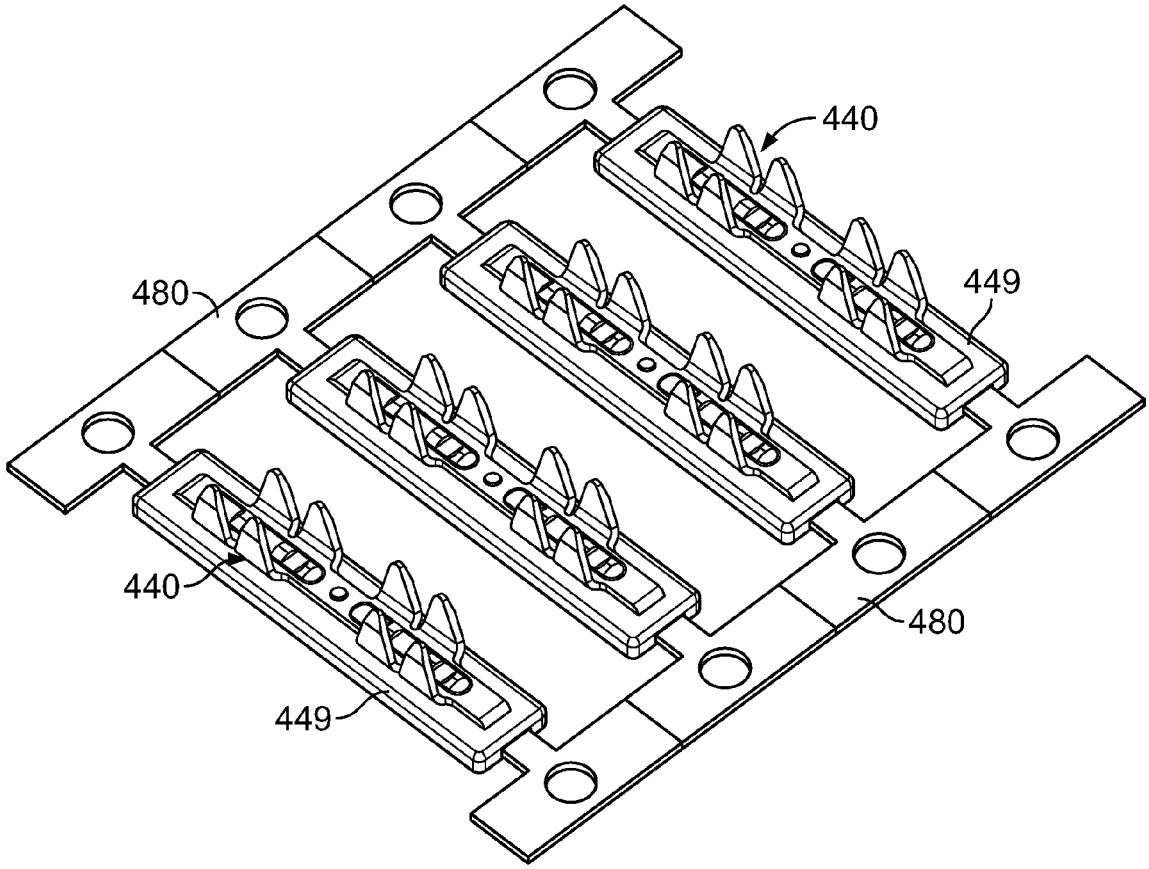
FIG. 4G is a top perspective view of multiple insulated transverse conducting members supplied on a continuous strip, ready for termination to flexible circuits.
Figure 4H:
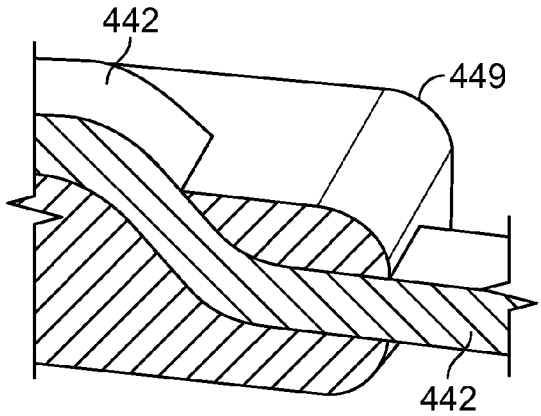
FIG. 4H is a detail of insulating material molded around one end of a transverse conducting member for mechanically securing the insulator to the metal contact.
Figure 4I:
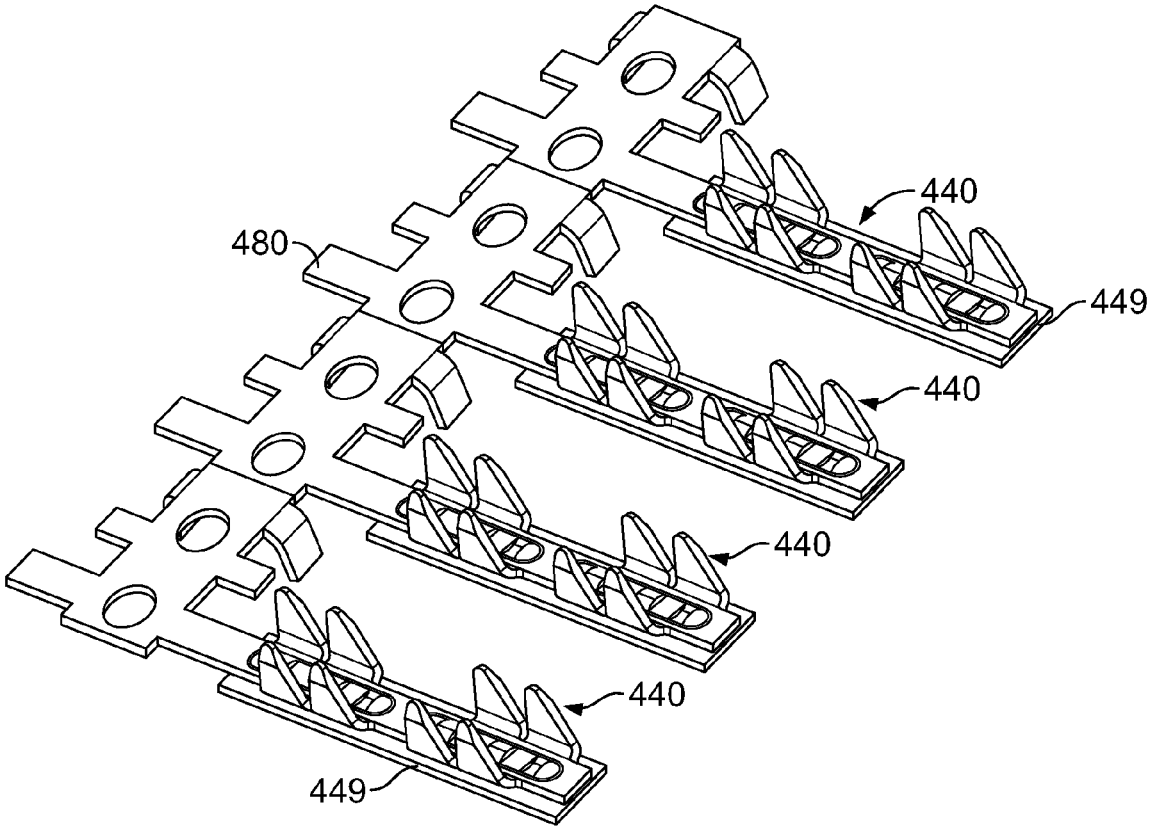
FIGS. 4I-J are top perspective views of an alternate version of FIG. 4G, wherein the insulated transverse conducting members are formed on a carrier rack, and wherein the insulated material is bonded to the bottom surface of each transverse conducting member.
Figure 4J:
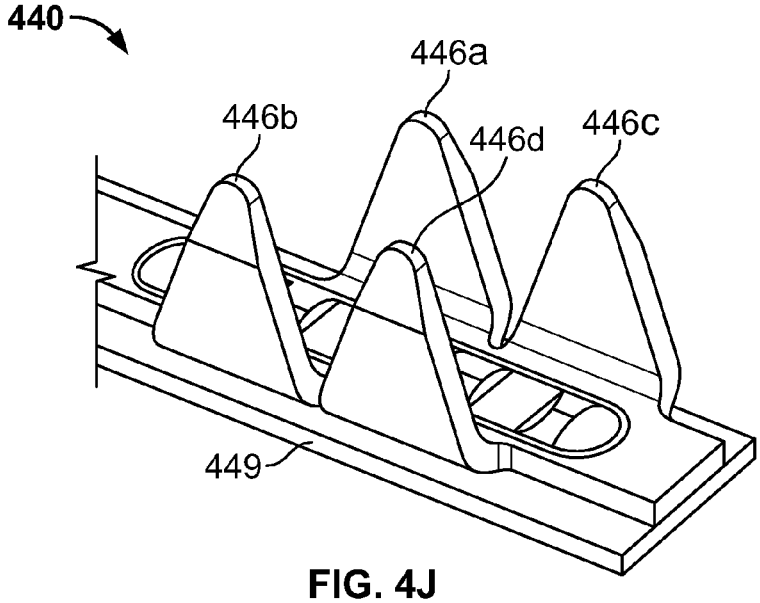
Figure 4K:
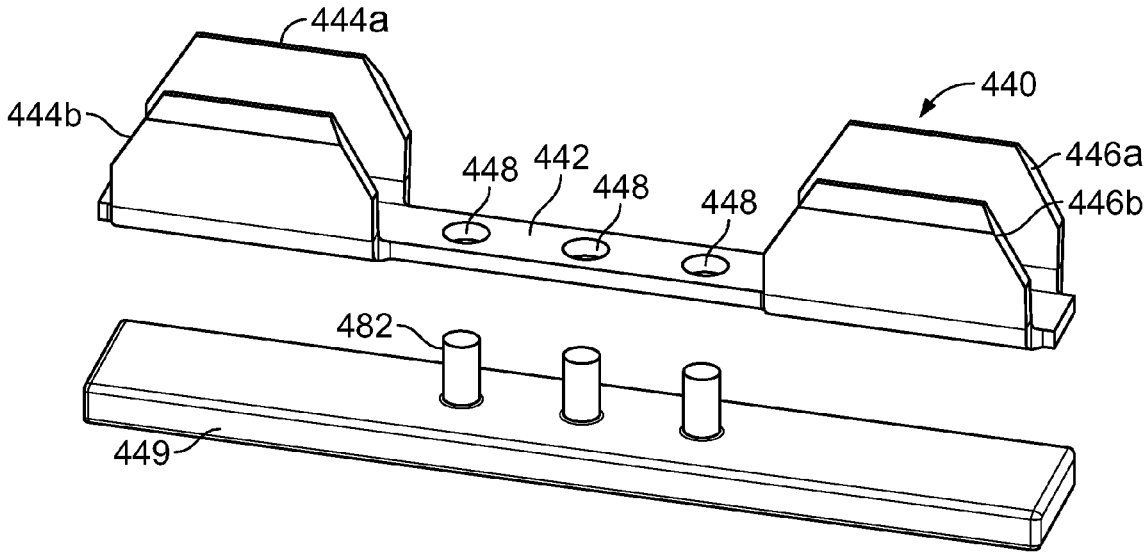
FIGS. 4K-M are multiple top perspective views of an alternate configuration of an insulated transverse conducting member according to the fourth general embodiment of the present invention, wherein a secondary molding is mechanically fastened to the metal terminal.
Figure 4L:
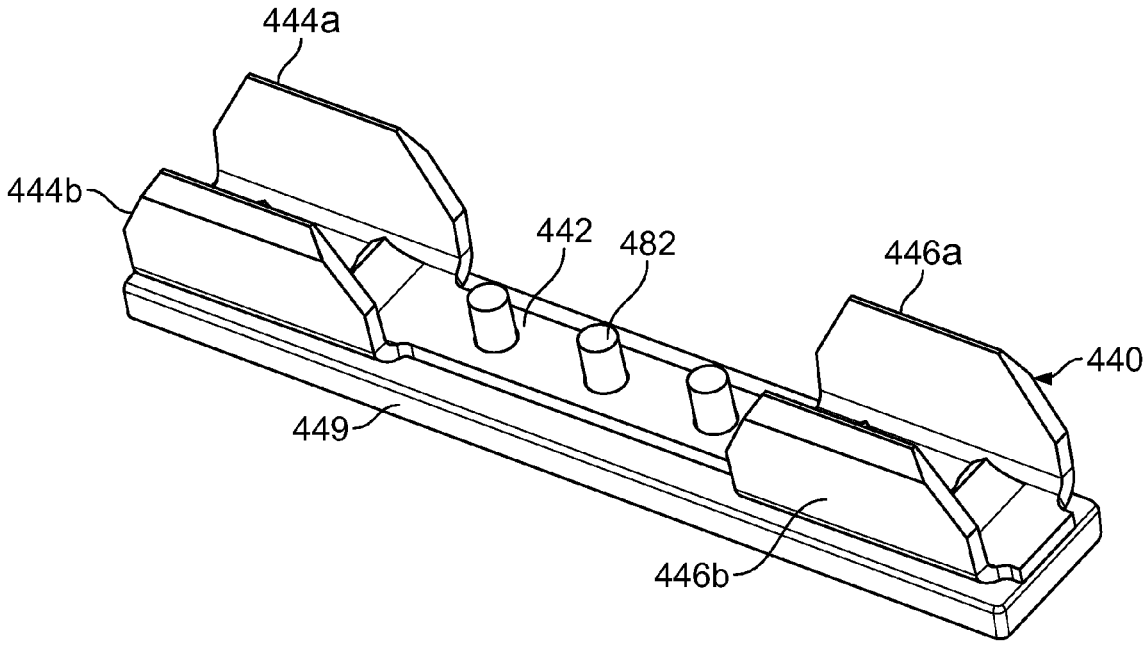
Figure 4M:
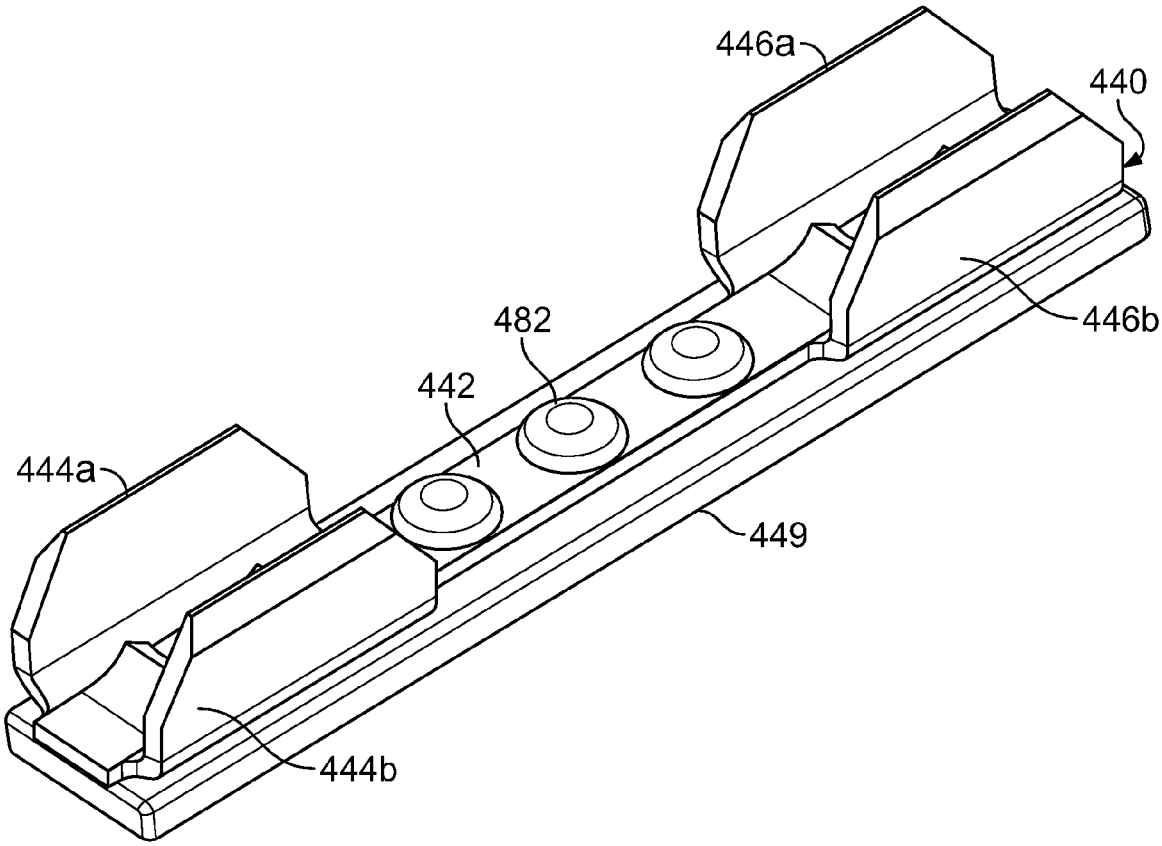
Figure 4N:
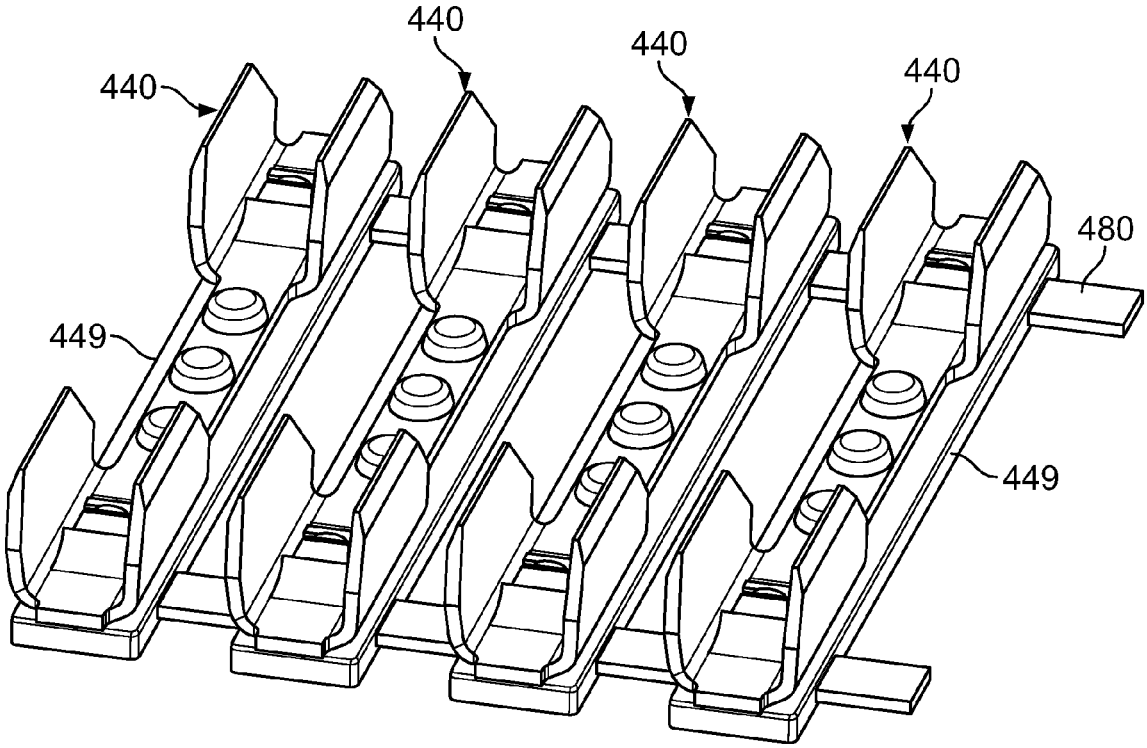
FIGS. 4N-O are top and bottom views respectively of the transverse conducting members of FIGS. 4K-M assembled on a carrier strip formed from insulating material.
Figure 4O:
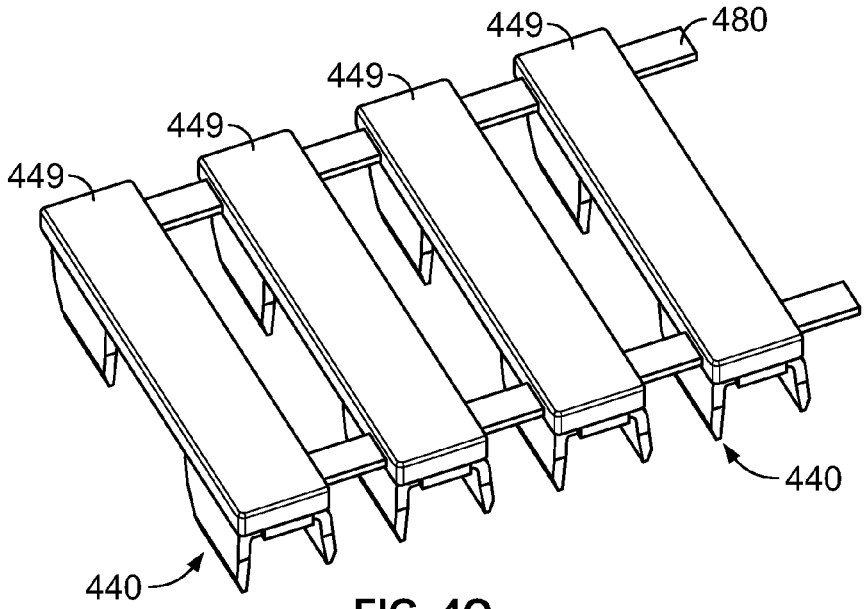

FIGS. 4A-4O provide various views of multiple versions of a fourth exemplary embodiment of the connector system of present invention that is useful for LED lighting applications in which a flat flexible cable is glued to a conductive metal panel or for other electronics applications. In the various versions of this embodiment shown in the Figures, a housing component is absent, and multiple flex circuits that include flat flexible cable or similar items (referred to herein as "component substrates") are connected to one another solely by one or more pre-insulated transverse conducting member 440. The component substrates that are connected to one another with this embodiment of the connector system of the present invention typically include a plurality of conductive pathways or traces disposed on at least one surface thereof. These traces function in a manner similar to the electrical contact surfaces previously described with regard to the other embodiments of this invention discussed herein. Thus, as shown in FIG. 4A, an exemplary component substrate 450*a* includes a non-conductive surface 450*b* and a non-conductive surface 450*c*. Likewise, an exemplary component substrate 452*a* includes a non-conductive surface 452*b* and a non-conductive surface 452*c*. Conductive traces 451 and 453 are disposed on surfaces 450*b* and 452*b* respectively.

With reference to FIGS. 4A-4J, each transverse conducting member 440 is a conductive metal contact that includes an elongated body 442 which bridges the flex circuits and connects the circuits to one another. First through fourth legs 444*a-d* are formed at one end of each transverse conducting member 440 and fifth through eighth legs 446*a-d* are formed at the opposite end of each transverse conducting member 440. At least one aperture 448 (see FIG. 4C) is typically formed in body 442. An insulating material 449 is applied to or formed around one side of each transverse conducting member for limiting the conductivity characteristics of the transverse conducting member. As shown in FIG. 4G, multiple individual transverse conducting members 440 may be provided on a metal carrier frame or strip 480 from which they may be removed when appropriate. Insulating material 449, which is typically a thermoplastic resin or similar material, is deposited around, i.e., applied to, each transverse conducting member 440 such that the terminal portions of each transverse conducting member 440 are encapsulated by the insulating material (see FIG. 4H). A portion of insulating material 449 may be forced through aperture 448 and subsequently formed into a retention feature for further securing the insulating material to the transverse conducting member (see also FIGS. 4K-4M). In the version of the fourth general embodiment shown in FIGS. 4I-4J, insulating material 449 includes a sheet of non-conductive Mylar®, polyester, or polymer film that is bonded by adhesive or other means to the bottom side of transverse conducting member 440, rather than being molded thereto.

As shown in FIGS. 4A and 4D, legs 444*a-d* are pierced through the material of component substrate 450*a* and crimped around or against conductive traces 451 for the purpose of attaching transverse conducting member 440 to first substrate 450*a* and forming an electrical connection therewith. Likewise, legs 446*a-d* are pierced through the material of component substrate 450*b* and crimped around or against conductive traces 453 for the purpose of attaching transverse conducting member 440 to second substrate 452*a* and forming an electrical connection therewith. Crimping the legs of each transverse conducting member 440 around the conductive traces in each flex circuit provides an effective electrical transmission path between the flex circuits. As shown in FIG. 4B, the insulating material that is applied to or formed around each transverse conducting member is situated in the same orientation as the electrically non-conductive surfaces of the substrates. This configuration allows the connected substrates, i.e., flex circuits, to be applied directly to an electrically conductive surface (e.g. steel) without the need for additional insulation between the flex circuits and the conductive surface. In an alternate configuration (shown in FIGS. 4E-F), transverse conducting members 440 may also be utilized to connect a flexible circuit to a series of flexible wires 470 by replacing legs 444*a-d* with a common wire crimp barrel that terminates to bare wire within insulators 472. As shown in the Figures, a flattened bottom portion of each insulator 472 is aligned with the non-conductive side 450*c* of substrate 450*a* thereby allowing the flex circuit assembly to be applied directly to an electrically conductive surface (e.g.

steel) without the need for additional insulation between the flex circuits and the conductive surface. This feature is typically common to all embodiments disclosed herein.

With reference to FIGS. 4K-4O, this version of the fourth general embodiment of the connector system of present invention provides an alternate manufacturing/assembly system for creating insulated transverse conducting members. In this embodiment, insulating material 449 is molded into either discrete insulators or a continuous carrier frame or strip 480 to which the individual transverse conducting members 440 are mechanically coupled. The molded insulating material 449 includes a plurality of retention posts 482, which are inserted through a corresponding plurality of apertures 448 formed in each body 442. Retention posts 482 are then heat staked (i.e., melted or otherwise deformed) to form a permanent or at least semi-permanent connection between each transverse conducting member 440 and insulating material 449. In this embodiment, an alternate geometry for legs 444*a-b* and 446*a-b* is also provided.

While the present invention has been illustrated by the description of exemplary embodiments thereof, and while the embodiments have been described in certain detail, it is not the intention of the Applicant to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the applicant's general inventive concept.

What is claimed:

1. A connector system for use with electronic devices, comprising:

(a) at least two component substrates, wherein each of the at least two component substrates further comprises at least one electrically conductive contact surface; and (b) at least one connector apparatus for connecting the at least two substrates to one another at the edges thereof, wherein the at least one connector apparatus enables electrical communication between the at least two substrates and further includes:

(i) at least one electrically conductive transverse conducting member, wherein a first portion of the transverse conducting member contacts the contact surface on the first substrate, and wherein a second portion of the transverse conducting member contacts the contact surface on the second substrate;

(ii) a substantially non-conductive housing component, and wherein the housing component further includes means for securing the at least one transverse conducting member therein; and (iii) means for securing the at least one transverse conducting member to each of the substrates and to each of the contact surfaces, wherein the means for securing the at least one transverse conducting member within the housing includes a protrusion formed within a central portion of the housing component, wherein the protrusion cooperates with an aperture formed in a central portion of the transverse conducting member.

2. The connector system of claim 1, wherein the at least two substrates further comprise printed circuit boards or flex circuits.

3. The connector system of claim 1, wherein the means for securing the at least one transverse conducting member within the housing includes deforming a portion of the at least one transverse conducting member within the housing component.

4. The connector system of claim 1, wherein the housing component further comprises at least one retaining member for guiding the printed circuit boards into the housing member when the connector system is being assembled.

5. The connector system of claim 1, wherein the at least one transverse conducting member further comprises a non-conductive insulator attached to a portion thereof.

6. The connector system of claim 1, wherein the at least one transverse conducting member further comprises a portion that is biased downward toward each contact surface when the connector system is assembled, and wherein each downwardly biased portion includes a terminal portion that physically touches the contact surface.

7. The connector system of claim 1, wherein the at least one transverse conducting member further comprises an elongated body, and wherein the elongated body further includes at least two protrusions for contacting the contact surfaces on each of the substrates.

8. The connector system of claim 1, wherein the at least one transverse conducting member further comprises a plurality of deformable legs, and wherein each of the substrates are adapted to receive each of the plurality of deformable legs.

9. The connector system of claim 8, wherein the means for securing the at least one transverse conducting member to each of the substrates and to each of the contact surfaces further comprises inserting the plurality of deformable legs through each of the substrates and crimping the legs around each substrate and against each contact surface.

10. A connector system for use with electronic devices, comprising:

(a) at least two component substrates, wherein each of the at least two component substrates further comprises at least one electrically conductive contact surface; and (b) at least one connector apparatus for connecting the at least two substrates to one another at the edges thereof, wherein the at least one connector apparatus enables electrical communication between the at least two substrates and further includes:

(i) at least one electrically conductive transverse conducting member, wherein a first portion of the transverse conducting member contacts the contact surface on the first substrate, and wherein a second portion of the transverse conducting member contacts the contact surface on the second substrate; and (ii) means for securing the at least one transverse conducting member to each of the substrates and to each of the contact surfaces, wherein the means for securing the at least one transverse conducting member to each of the substrates and to each of the contact surfaces further comprises hook-like structures formed on either side of the transverse conducting member and apertures formed in each of the substrates that correspond to the hook-like structures formed on the transverse conducting member.

11. A connector for use with at least two electronic component substrates, wherein each of the at least two substrates further includes at least one electrically conductive contact surface, the connector comprising:

(a) a connector apparatus for connecting the at least two substrates to one another at the edges thereof and enabling electrical communication therebetween, wherein the connector apparatus further includes:

(i) at least one electrically conductive transverse conducting member, wherein a first portion of the at least one transverse conducting member contacts the contact surface on the first substrate, and wherein a second portion of the transverse conducting member contacts the contact surface on the second substrate; and (ii) a substantially non-conductive housing component, wherein the housing component further includes means for securing the at least one transverse conducting member therein; and (iii) mechanical means for securing the at least one transverse conducting member to each of the substrates and to each of the contact surfaces, wherein the means for securing the at least one transverse conducting member within the housing includes a protrusion formed within a central portion of the housing component, wherein the protrusion cooperates with an aperture formed in a central portion of the transverse conducting member.

12. The connector of claim 11, wherein the at least two electronic component substrates further comprise printed circuit boards or flex circuits.

13. The connector of claim 11, wherein the means for securing the at least one transverse conducting member within the housing includes deforming a portion of the at least one transverse conducting member within the housing component.

14. The connector of claim 11, wherein the housing component further comprises at least one retaining member for guiding the substrates into the housing member when the connector system is being assembled.

15. The connector of claim 11, wherein the at least one transverse conducting member further comprises a non-conductive insulator attached to a portion thereof.

16. The connector of claim 11, wherein the at least one transverse conducting member further comprises a portion that is biased downward toward each substantially planar contact surface when the connector system is assembled, and wherein each downwardly biased portion includes a terminal portion that physically contacts the substantially planar surface.

17. The connector of claim 11, wherein the at least one transverse conducting member further comprises an elongated body, and wherein the elongated body further includes at least two inwardly facing protrusions for contacting the substantially planar contact surfaces on each of the printed circuit boards.

18. The connector of claim 11, wherein the at least one transverse conducting member further comprises a plurality of deformable legs, and wherein the substrates are adapted to receive the plurality of deformable legs.

19. The connector of claim 18, wherein the mechanical means for securing the at least one transverse conducting member to each of the substrates and to each of the contact surfaces further comprises inserting the plurality of deformable legs through each of the substrates and crimping the legs around each substrate and against each contact surface.

20. A connector for use with at least two electronic component substrates, wherein each of the at least two substrates further includes at least one electrically conductive contact surface, the connector comprising:

(a) a connector apparatus for connecting the at least two substrates to one another at the edges thereof and enabling electrical communication therebetween, wherein the connector apparatus further includes:

(i) at least one electrically conductive transverse conducting member, wherein a first portion of the at least one transverse conducting member contacts the contact surface on the first substrate, and wherein a second portion of the transverse conducting member contacts the contact surface on the second substrate; and (ii) mechanical means for securing the at least one transverse conducting member to each of the substrates and to each of the contact surfaces, wherein the mechanical means for securing the at least one transverse conducting member to each of the substrates and to each of the contact surfaces further comprises hook-like structures formed on either side of the transverse conducting member and corresponding apertures formed in each of the substrates.

21. A method for connecting substrates for use with electronic devices to one another, comprising:

(a) providing at least two electronic component substrates, wherein each of the at least two substrates further comprises an electrically conductive contact surface;

(b) providing at least one connector apparatus for connecting the at least two substrates to one another at the edges thereof wherein the at least one connector apparatus enables electrical communication between the at least two substrates and further includes:

(i) at least one electrically conductive transverse conducting member, wherein a first portion of the at least one transverse conducting member contacts the contact surface on the first printed circuit board, and wherein a second portion of the transverse conducting member contacts the contact surface on the second printed circuit board; and (ii) mechanical means for securing the at least one transverse conducting member to each of the substrates and to each of the contact surfaces, wherein the mechanical means for securing the at least one transverse conducting member to each of the substrates and to each of the contact surfaces further comprises hook-like structures formed on either side of the transverse conducting member and corresponding apertures formed in each of the substrates; and (c) electrically connecting the at least two substrates to one another by contacting the at least one transverse conducting member with the contact surfaces on each substrate; and (d) physically connecting the at least two substrates to one another by engaging the mechanical means for securing the at least one transverse conducting member to each of the substrates and to each of the contact surfaces.

22. The method of claim 21, further comprising attaching an electrically non-conductive insulator to a portion of the at least one transverse conducting member.

23. The method of claim 21, wherein the connector apparatus further comprises a substantially non-conductive housing component, and wherein the housing component further includes mechanical means for securing the at least one transverse conducting member therein.

24. The method of claim 21, wherein the at least one transverse conducting member further comprises a plurality of deformable legs, and wherein the substrates are adapted to receive the plurality of deformable legs.

25. The method of claim 24, wherein the mechanical means for securing the at least one transverse conducting member to each of the substrates and to each of the contact surfaces further comprises inserting the plurality of deformable legs through each of the substrates and crimping the legs around each substrate and against each contact surface.

* * * * *